US008327548B2

(12) United States Patent
Ronan

(10) Patent No.: US 8,327,548 B2
(45) Date of Patent: Dec. 11, 2012

(54) UTILITY CUTTER WITH A NON-TOOL BLADE CHANGER

(76) Inventor: John S. Ronan, Temecula, CA (US)

( * ) Notice: Subject to any disclaimer, the term of this patent is extended or adjusted under 35 U.S.C. 154(b) by 635 days.

(21) Appl. No.: 12/458,611

(22) Filed: Jul. 17, 2009

(65) Prior Publication Data

US 2010/0212162 A1 Aug. 26, 2010

Related U.S. Application Data

(60) Provisional application No. 61/202,358, filed on Feb. 23, 2009.

(51) Int. Cl.
*B26B 17/00* (2006.01)

(52) U.S. Cl. ..... 30/175; 30/186; 30/187; 30/188; 30/191; 30/192; 30/193; 30/236; 30/244; 30/254

(58) Field of Classification Search ..... 30/108, 30/134, 135, 176, 186–188, 175, 191–194, 30/234–236, 244, 248, 250, 252, 254, 257–262, 30/329–339, 341; D8/5, 52, 98
See application file for complete search history.

(56) References Cited

U.S. PATENT DOCUMENTS 1,401,546 A * 12/1921 Mae ..... 30/191
1,831,609 A * 11/1931 Schroder ..... 30/186
1,963,564 A * 6/1934 Smith et al. ..... 30/186
1,995,044 A * 3/1935 Smith ..... 30/186
2,295,385 A * 9/1942 Connors ..... 30/193
D151,791 S * 11/1948 Smith ..... D8/5
2,528,815 A * 11/1950 Boyer ..... 30/193
2,574,354 A * 11/1951 Smith ..... 30/186
2,807,087 A * 9/1957 Smith ..... 30/186
3,323,209 A * 6/1967 Brill, Jr. ..... D8/5
3,324,549 A * 6/1967 Sharp ..... 30/193
3,336,667 A * 8/1967 Wallace et al. ..... 30/135
3,688,405 A * 9/1972 Dutra et al. ..... 30/135
3,772,783 A 11/1973 Averitt
4,079,513 A * 3/1978 Harrison ..... 30/193
4,094,064 A * 6/1978 Nishikawa et al. ..... 30/192
4,947,553 A * 8/1990 Bendickson et al. ..... 30/262
D323,769 S * 2/1992 Ishida et al. ..... D8/5
5,170,559 A * 12/1992 Orthey et al. ..... 30/134
5,497,554 A 3/1996 Hamlin
(Continued)

FOREIGN PATENT DOCUMENTS

EP 1031399 A1 * 8/2000
(Continued)

*Primary Examiner* — Jason Daniel Prone
(74) *Attorney, Agent, or Firm* — Patent Analysis Research Technology Systems; George L. Walton

(57) ABSTRACT

A multi-function blade-and-anvil type cutting tool that uses standard type razor blades includes a blade-and-anvil section connected to a first handle portion and a non-tool blade holder and a blade clamp assembly connected to a second handle portion. The standard blades are able to be changed with out tools when the first and second handle portions are moved from a first open position to a second open position to allow the blade holder and the clamp assembly to pivot with one another causing a screw and O-ring latch to move away from a latching slot in the second handle portion. This movement positions the razor blade between the screw and O-ring latch and a blade clamp guide element for easy removal. Each handle portion having a gripping cover disposed thereon. One of the handle portions has a sliding storage tray disposed therein for storing replacement razor blades.

15 Claims, 17 Drawing Sheets

U.S. PATENT DOCUMENTS

| | | | | | |
|---|---|---|---|---|---|
| 5,625,951 | A | | 5/1997 | Hamlin | |
| D387,965 | S | | 12/1997 | Ronan | |
| 5,715,604 | A | * | 2/1998 | Lanzoni | 30/192 |
| D398,499 | S | | 9/1998 | Ronan | |
| 5,890,293 | A | | 4/1999 | Gamba | |
| D416,452 | S | * | 11/1999 | Budrow | D8/5 |
| 6,000,137 | A | | 12/1999 | Gamba | |
| D422,463 | S | | 4/2000 | Ronan | |
| D422,856 | S | * | 4/2000 | Wu | D8/5 |
| 6,049,985 | A | * | 4/2000 | Gonzalez et al. | 30/233 |
| D424,899 | S | * | 5/2000 | Jaime | D8/52 |
| D427,036 | S | | 6/2000 | Ronan | |
| 6,105,256 | A | * | 8/2000 | Budrow | 30/186 |
| D434,955 | S | | 12/2000 | Ronan | |
| 6,260,279 | B1 | | 7/2001 | Apolinski et al. | |
| 6,269,542 | B1 | | 8/2001 | Gamba | |
| 6,305,087 | B1 | * | 10/2001 | Huang | 30/250 |
| D450,551 | S | * | 11/2001 | Lai | D8/5 |
| D455,329 | S | * | 4/2002 | Renner | D8/98 |
| D467,476 | S | * | 12/2002 | Lai et al. | D8/5 |
| 6,625,888 | B2 | * | 9/2003 | Heck et al. | 30/186 |
| D483,627 | S | | 12/2003 | Ronan et al. | |
| 6,698,099 | B2 | | 3/2004 | Ronan et al. | |
| 6,757,979 | B1 | * | 7/2004 | Schneider | 30/186 |
| D503,875 | S | | 4/2005 | Ronan et al. | |
| 7,080,455 | B1 | | 7/2006 | Ronan et al. | |
| D564,309 | S | * | 3/2008 | Ronan | D7/696 |
| D628,031 | S | * | 11/2010 | Stokes et al. | D8/5 |
| 7,966,734 | B2 | * | 6/2011 | Crain et al. | 30/254 |
| D648,197 | S | * | 11/2011 | Lin | D8/52 |
| D652,276 | S | * | 1/2012 | Good | D8/52 |
| 2004/0045173 | A1 | * | 3/2004 | Ebert | 30/188 |
| 2005/0050735 | A1 | * | 3/2005 | Huang | 30/186 |
| 2006/0207101 | A1 | * | 9/2006 | Scarla | 30/145 |
| 2007/0204470 | A1 | * | 9/2007 | Lai | 30/244 |
| 2009/0223059 | A1 | * | 9/2009 | Yu Chen | 30/250 |
| 2011/0185577 | A1 | * | 8/2011 | Ronan | 30/192 |

FOREIGN PATENT DOCUMENTS

| | | | |
|---|---|---|---|
| WO | WO 0240230 | A1 * | 5/2002 |

* cited by examiner

UTILITY CUTTER WITH A NON-TOOL BLADE CHANGER

CROSS REFERENCE TO RELATED APPLICATION(S)

This application is based upon and claims the priority of U.S. Provisional Patent Application Ser. No. 61/202,358, filed on Feb. 23, 2009.

BACKGROUND OF THE INVENTION

1. Field of the Invention

The present invention relates generally to conventional fixed blade knives/shears and other cutter type devices. More particularly, the present invention relates to blade and anvil type cutting devices or tools that can be easily converted to conventional fixed blade knives/shears type cutting devices. This invention more specifically relates to a utility cutting device with a blade holder and a movable or pivoted blade clamp changing mechanism for easily removing razor cutting blades from the utility cutting device without the use of any tools. Further, the present invention relates to a razor blade storage compartment within a handle gripping cover positioned on at least one of the pair of pivoted handle of the utility cutting device.

2. Description of the Related Art

Prior art conventional fixed-blade knives/shears define utility cutting devices or tools with a pair of handles, a fixed cutting blade with a cutting section and an anvil member. One of the handle is connected to the cutting blade and the other handle is connected to the anvil member. The pair of handles is affixed to one another by a pivot member and a spring element that allows the handles to be pivoted in a scissor movement action towards an open position. This scissor movement allows the cutting blade to cut material or objects that are placed on the anvil below the cutting blade, as the cutting blade is moved towards the anvil member, when a user forces or squeezes the handles together.

It is well known in the prior art to have blade and anvil type cutters that can be converted between a knife type cutting and a blade and anvil type cutting. These types of cutting devices or tools include a knife member and a companion conversion member that locks onto a knife member when desired. At least a portion of the knife is sharpened to provide a secondary cutting edge, and the conversion member locks onto the knife member by a pivoting means top provide an anvil member that works in opposition to the secondary cutting edge for cutting materials or objects. These blade and anvil type cutting tools or devices can be quickly and easily converted between a knife type cutting and a blade and anvil type cutting by removably attaching the conversion member.

Also, it is well known in the prior art to have razor blade changing mechanisms associated with utility cutting devices or tools for replacing the razor blades of utility cutting devices or tools with the use and without the use of tools.

Furthermore, it is well known in the prior art to have razor blade storage compartments within a handle member or a body portion of utility cutting devices or tools.

Finally, it is well known in the prior art to have spring or biasing elements and locking mechanisms cooperatively associated with pivoted handles of utility cutting devices or tools.

There are many shortcomings in the above prior art cutting devices or tools. One of the shortcomings being that the prior art blade changing mechanisms are too cumbersome and requires too many parts or movements. Many of the prior art blade changing mechanisms have to use tools for replacing razor blades. Many of the blade changing tools are bulky and time consuming in replacing razor blades of the prior art utility cutting devices. Some of these tools have to be incorporated or attached to the prior art utility cutting devices or tools, which take up additional space. Even for the prior art cutting devices or tools that do not utilize tools, they have to be shaken vigorously so that the razor blades are loosen which can cause the razor blade to fly out, which can cause serious injury to someone or utilizes more force to remove them.

Another shortcoming is that the body of utility cutting devices or tools has to be machined or designed to include a space or compartment to store replacement razor blades. Such space or compartment design can increase cost and size of the utility cutting devices or tools. Also, this design can take away from the aesthetics of the utility cutting devices or tools.

As a result of the above shortcomings, various types of well known blade and anvil type cutting tools or devices and shear cutting tools with spring-biased handles, an anvil, a cutting blade, blade changing mechanisms and handle locking means in part or in total are disclosed in the following prior art patents.

U.S. Pat. No. 3,336,667 teaches a pruning cutter with a pair of spring biased handles with a locking feature, a screw clamp and blade holder assembly, an anvil and a cutting razor blade.

U.S. Pat. No. 3,772,783 teaches a hand clipper/cutter with a pair of spring biased handles with a locking feature, a screw clamp and blade holder assembly, an anvil and a cutting razor blade.

U.S. Pat. No. 5,497,554 teaches a plier-type hand cutting tool with a pair of handles with cutting edges and a non-tool replaceable blade mechanism that is pivoted to an open position for replacing razor blades.

U.S. Pat. No. 5,625,951 teaches a combination hand cutting tool with a pair of handle plates and a non-tool replaceable blade mechanism that is pivoted to an open position for replacing razor blades.

U.S. Pat. No. 5,890,293 teaches a hand cutting tool with a pair of pivoted frame handles and a blade storage mechanism for storing replaceable blades. A blade holder assembly releases a razor blade by a manual screw means.

U.S. Pat. No. 6,000,137 teaches a hand cutting tool with a pair of handles and a blade storage mechanism for storing replaceable blades. A blade holder assembly releases a razor blade by a manual screw means.

U.S. Pat. No. 6,260,279 teaches a combination hand cutting tool with a pair of handles with one of the handles having a razor blade and tool storage compartment, one of the handles having an anvil, the other handle having a razor blade and a razor blade holder with screw clamp means for replacing razor blades.

U.S. Pat. No. 6,269,542 teaches a multi-purpose hand cutting tool with a pair of pivoted frame handles and a blade storage compartment for storing replaceable blades. This multi-purpose hand cutting tool includes a blade holder assembly that releases a razor blade by a manual screw means. A plurality of tools may be packaged as a kit with one of the handles.

U.S. Pat. No. 6,625,888 teaches a multi-purpose hand cutting tool with a pair of pivoted spring-biased handles and a blade storage compartment with a handle grip cover for storing replaceable blades. This multi-purpose hand cutting tool includes a razor blade holder screw clamp assembly that releases a razor blade by a manual screw means.

U.S. Pat. No. 6,698,099 teaches a prior art convertible knife assembly with a blade-and anvil portion and a pair of spring-biased pivoted handles.

U.S. Pat. No. 7,080,455 teaches a prior art handheld convertible kitchen knife appliance having a blade-and anvil portion and a pair of spring-biased pivoted handles.

U.S. Patent Publication No. 2005/00500735 teaches a hand cutting tool with a pair of pivoted spring-biased handles with a blade storage compartment in one of the pivoted handles and a locking feature for the pivoted handles. A sliding handle grip cover being positioned over the one pivoted handle for exposing the blade storage compartment to gain access to stored replacement razor blades. A razor blade holder and screw clamp assembly that releases a razor blade by a manual screw means.

U.S. Patent Publication No. 2006/0207101 teaches a hand cutter with a pair of spring biased handles with a locking feature, a fastener clamp and blade holder assembly, an anvil and a cutting razor blade.

Additional prior art patents of the hand-held blade-and-anvil type and other shear type cutting tools are hereby recited of interest without further description thereof. Such prior art are disclosed in U.S. Design Pat. Nos. D387,965, D398,499, D422,463, D427,036, D434,955, D483,627 and D503,875.

Although these prior art cutting devices or tools might be creative, and well-thought-out inventions, that function well for their intended purposes at the time of their creation, but some, if not all are cumbersome and not timely in replacing cutting razor blades from a blade holder and blade clamp assembly, utilizes too much space in the body of the cutting devices or tools to define razor blade storage compartments and requires unnecessary tools, screws or force to remove the razor blades from the blade holder and blade clamp assembly.

However, all of the embodiments of the preferred invention overcomes all of the above shortcomings and provide a unique non-tool blade holder and blade clamp assembly that is moved to a second open position to easily remove razor blades there from as the blade holder and blade clamp assembly is unclamped from a clamping slot in a portion of a second pivoted handle member. This unclamping is achieved by an O-ring and screw assembly of the blade holder and blade clamp assembly and the clamping slot in a portion of a second pivoted handle member. Also, none of the prior art patents teach the unique sliding spring-biased detent storage tray for replacement razor blades solely within a handle grip cover and not in the body of a cutting device or tool.

SUMMARY OF THE INVENTION

The present invention is a blade and anvil type cutting tool or device that uses standard type razor blades with an integral non-tool blade changing blade holder assembly and a blade clamp assembly. The standard blades are able to be changed with out tools when the blade holder assembly and the clamp assembly moves away from a latching slot in a sectional portion in one of a pair of handles of the blade and anvil type cutting tool or device into a second fully open blade release position by pivoting the pair of handles beyond a first open position. The first open position allows for material or objects to be placed between a cutting surface of an anvil member and a cutting blade of blade holder and blade clamp assemblies.

An improved non-tool blade changer assembly according to a first preferred embodiment of the present invention includes a cutting tool or device having an anvil assembly that is connected to a first handle gripping portion by an intermediate portion and a blade holder and blade clamp assembly that is connected to a second handle gripping portion. The first handle portion includes a rear hand gripping end, an intermediate securing section and a front anvil section. The anvil section includes at least a pair of fastening holes that receives respective threaded fastener elements. The intermediate securing section includes an elongated opening that receives a latching member there through. Also, a threaded fastening element is disposed through a fastening opening within the intermediate securing section to act as a pivot element to permit the first and second handle portions to pivot relative to one another.

The handle portions having spaced apart complimentary portions. The first handle portion has a complimentary handle portion (not shown) with a complimentary front anvil section connected thereto (not shown) that includes at least a pair of fastening holes (not shown) that receives the respective threaded fasteners therein from the one that is shown in the drawings. The complimentary handle portion (not shown) has a complimentary intermediate securing section (not shown) that includes another complimentary elongated opening (not shown) that receives a latching member there through with a latch holding fastener (not shown) for fastening the latching members within both of the elongated openings and secured at the intermediate sections to allow the complimentary latching members to slide within the elongated openings between latched and unlatched positions. Also, the threaded fastening element is disposed through a fastening opening within the intermediate securing section and through a complimentary fastening opening (not shown) and through the complimentary intermediate securing section (not shown) to receive a threaded nut or fastener element (not shown) for pivotally securing the spaced apart handle portions together to permit the handle portions to pivot relative to one another between open and closed positions.

Still referring to the first handle complimentary portions, a plastic spacer member is disposed between the intermediate portions and the handle gripping portions with a plurality of fastening elements for securing them together. A plastic anvil member is secured between the complimentary anvil sections for securing the anvil sections together by the pair of anvil threaded fastener elements. Optionally, the handle gripping portions and the intermediate portions could have a thickness that would be comparable to the thickness of the plastic spacer to coincide with the thickness of the plastic anvil sections and the anvil member.

The second handle portion includes a rear hand gripping end, an intermediate securing section and a front blade holder and blade clamp front section. The second handle portion further includes a complimentary rear hand gripping end and a front end portion that is complimentary to the intermediate securing section of the second handle portion. A blade holder clamp assembly is secured to a front portion of the blade holder and blade clamp front section by a plurality of fastening members. Also, a blade holder assembly for holding a razor blade element thereon is attached to a rear portion of the front blade holder and blade clamp front section. Note that the blade holder clamp assembly and the blade holder assembly are cooperatively and pivotally associated with one another via the plurality of blade clamp assembly fastening members. At least a rear portion of the blade holder is pivotally secured and sandwiched between the intermediate securing sections first and second handle portions and the complimentary front end portion of the second handle portion. The remaining portion of the blade holder is exposed to the back side of the front blade holder and blade clamp front section and secured thereto.

Note that the cooperative and pivotal association between the blade clamp assembly, the blade holder assembly and the handle portions allows the blade holder assembly to move together with the handle portions between open and closed positions. Upon the handle portions being moved from a closed position to a first open position the razor blade element of the blade holder assembly is moved away from the anvil member to permit material or objects to be placed there between to be cut when the handle portions are moved back to a closed position. When the handle portions are moved further outward of the first open position, a second open release position is achieved. This open release position allows the blade holder assembly to be pivotally released from the blade clamp assembly to allow easy removal of the razor blade without the use of tools.

In a second preferred embodiment of the present invention, a modification of how the handle portions are created will be discussed. The first and second handle portions are made from a sheet of sturdy stamped metal material and folded to form a single handle member. Note that the folding creates open portions. The first handle open portion extends from its front anvil section to the rear gripping end with a cut-out section extending from an intermediate section to the front anvil section. Note that the intermediate cut-out section enables the second handle portion with clamp holder assembly and the blade holder assembly to be inserted there through so that the intermediate sections of the first handle and second handle portions, a complimentary front end portion of the second handle portion and the rear portion of the blade holder assembly are pivotally secured together to be moved between open and closed positions. The front anvil cut-out section allows for the aforementioned anvil member to be secured therein by the above anvil fasteners within the at least a pair of anvil fastening holes.

In addition, the second preferred embodiment of the present invention, the first and second handle gripping ends includes a handle gripping member thereon. The first handle portion between the rear gripping end and the intermediate securing section defines an inclined abutment surface. The first handle gripping handle member has an opening therein for receiving a sliding razor blade storage tray. Note that the inclined abutment surface extends downwardly a desired distance from the first handle portion rear gripping end to form a desired space of a certain height within the opening of the handle gripping member when it is installed on the rear gripping end of the first handle portion. This desired space allows the sliding tray to clear the under portion of the rear gripping end of the first handle portion. Also, when additional razor blades are stored within the tray, the tray will be able to move freely within the opening of the handle gripping member without any complications. Furthermore, the sliding tray forward end will abut the inclined abutment surface when the tray is fully inserted within the handle gripping member of the first handle portion. Also, the sliding tray has at least a pair of spring-loaded retention members on opposite sides thereof to latch the tray within the handle gripping member against at least a pair of retention surfaces on opposite sides therein. The sliding tray rear end has a gripping end surface for allowing a user to easily grip and move the sliding tray in and out of the handle gripping member.

Finally, this blade and anvil type cutting tool or device can be converted easily into a multi-function tool such as a utility knife and an anvil cutting tool by merely selectively adjusting the blade relative to the anvil in one of a plurality of selected adjustment apertures or slots of a stand razor blade.

In accordance with a still further aspect of the present invention, the handle portions, the blade clamp and blade holder assemblies, the anvil member, the sliding tray, and the handle gripping members could be made out of various type of materials, such as different types of plastic, metal, to name just a few. However, any combination of materials could be utilized, if desired, to one of ordinary skill in the art, at the time the invention was made.

BRIEF DESCRIPTION OF THE DRAWINGS

The present invention may be better understood, along with its numerous objects, features, and advantages made apparent to those skilled in the art by referencing the accompanying drawings.

DETAILED DESCRIPTION

Reference will now be made in detail to the preferred embodiments of the invention, examples of which are illustrated in the accompanying drawings. While the invention will be described in conjunction with the accompanying drawings, it will be understood that they are not intended to limit the invention to the accompanying drawings. On the contrary, the present invention is intended to cover alternatives, modifications and equivalents, which may be included within the spirit and scope of the invention as defined by the appended claims.

Figure 1:
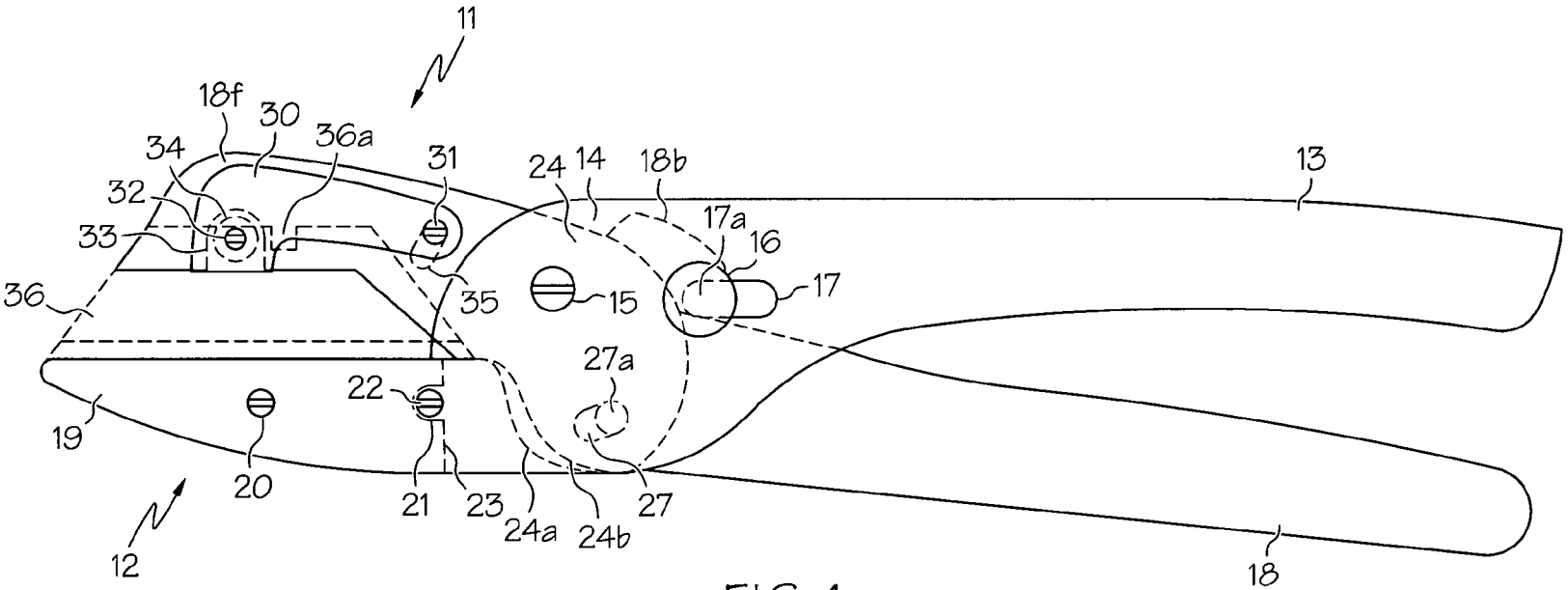
FIG. 1 illustrates a perspective view of a closed position of a standard blade and anvil type cutting tool or device with an integral non-tool blade changing blade holder assembly and a blade clamp assembly according to a first preferred embodiment of the present invention.

FIG. 1 of the first preferred embodiment of the present invention shows a utility cutter device with blade holder and blade clamp assemblies 11 and an anvil section 12. The utility cutter includes handle portions 13 and 18 with spaced apart complimentary handle portions. The handle portions 13 and 18 have a spacer member (not shown) there between for securing the handle complimentary portions together with a plurality of fastening means (not shown). Handle portion 13 has a complimentary handle portion (not shown) with a complimentary anvil section 19 connected thereto (not shown) that includes at least a pair of fastening holes (not shown) that receives threaded fasteners 20 and 21 therein for securing the anvil sections together. The complimentary handle portion (not shown) has a complimentary intermediate securing section 14 (not shown) that includes another complimentary elongated opening 17 (not shown) that receives a latching member 16 there through with a latch holding fastener (not shown) for fastening the latching member 16 within both of the elongated openings 17 and secured against the complimentary handle portion 13 (not shown). Also, the threaded fastening element 15 is disposed through a fastening opening within the intermediate securing section 14 and through a complimentary fastening opening (not shown) and through the complimentary intermediate securing section (not shown) to receive a threaded nut or fastener element (not shown) for pivotally securing the spaced apart handle portions 13 together to permit the handle portions 13 and 18 to pivot relative to one another between open and closed positions.

The dotted lines shown in FIG. 1 depict a portion of a blade holder member 24 with an elongated opening 27 and a pin element 27*a* movable therein to allow the blade holder to move together with the handle portion 18 and 18*a* (shown in FIG. 3) relative to handle portions 13. Also, the dotted lines of the blade holder 24 show an indented or arcuate portion 24*a* and an incline portion 24*b* extending there from. The blade holder 24 is sandwiched between the handle portions 13 and 18. Further details of the blade holder 24 will be discussed later. The dotted lines define a latching u-shape slot 18*c* and a raised or fin-like element 18*b* disposed intermediate the front portion 18*f* and an end of handle portions 18. Note that element 17*a* will receive latching member 16 therein when the handle portions 13 and 18 are moved to a closed position as shown in FIG. 1 and latching member 16 is moved into U-shaped slots 18*c*, 18*e* (see FIGS. 3 and 4) and elongated opening 17 to the latched closed position.

Still referring to the invention as shown in FIG. 1, the handle portion 13 and the complimentary handle portion 13 (not shown) includes a plastic anvil member 23, shown in dotted lines, disposed there between. The anvil member further includes a screw fastening openings 20*a* (shown in FIG. 7) and an oversized fastening u-shaped slot 22 there through for receiving screw fastening elements 20 and 21, respectively, to tightly secure the anvil member 23 between the above discussed anvil sections 19. Note that a fastening nut could be utilized to engage the complimentary anvil section (not shown) to tightly secure the anvil member 23 between the above discussed anvil sections 19. The oversized u-shaped slot 22 allows the anvil 23 to slightly pivot or move about screw fastener 21 while adjusting or screwing screw fastener 20 in screw fastener opening 20*a*. This makes sure that the anvil member 23 is properly aligned.

Figure 2:
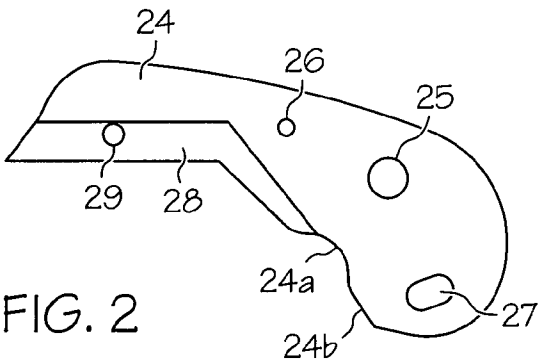
FIG. 2 illustrates a side view of the blade holder assembly according to the first preferred embodiment of the present invention.

Referring now to FIG. 2, the blade holder 24 includes the elongated pin opening 27 and a pivot fastening opening 25 for receiving the threaded fastening element 15 that is disposed through the fastening opening within the intermediate securing section 14 and through the complimentary fastening opening (not shown) and through the complimentary intermediate securing section (not shown) to receive a threaded nut or fastener element (not shown) for pivotally securing the spaced apart handle portions 13 together to permit the handle portions 13 and 18 to pivot relative to one another between open and closed positions. The blade holder also includes a screw fastening opening 26 that will receive a fastening screw 31 through a screw fastening opening 31*a* of blade clamp member 30 which will bottom out in screw fastening opening 26. Also, the fastening screw 31 will move along an elongated slot 35 in a front portion 18*f* of handle portion 18 (see FIGS. 5, 8 and 9 for more details) to allow the clamp member 30 to pivot up and down between the first and second open positions. FIG. 2 also depicts an angled cut-out section 28 that extends from a front edge of 18*f* to one end of the indented or arcuate portion 24*a*. An inclined or slanted portion 24*b* extends from the other end of 24*a* to the lower rounded portion of the blade holder. The cut-out section 28 is machined into a side portion of blade holder 24 at a depth to fully receive an upper and side portion of a complimentary shape standard cutting blade 36. Within the cut-out section 28 near a front edge of front portion 18*f* a screw opening 29 is disposed therein to receive a fastening screw fastener 32 for securing the other end of the clamp 30 to the front portion 18*f* spaced from screw fastener 31. As shown in dotted lines in FIG. 1, the front portion 18*f* has a large u-shape slot 33 that frictionally or tightly receives a rubber gasket or O-ring 34 that is disposed about the screw fastener 32. Details of the purpose for the gasket or washer will be discussed later.

Figure 3:
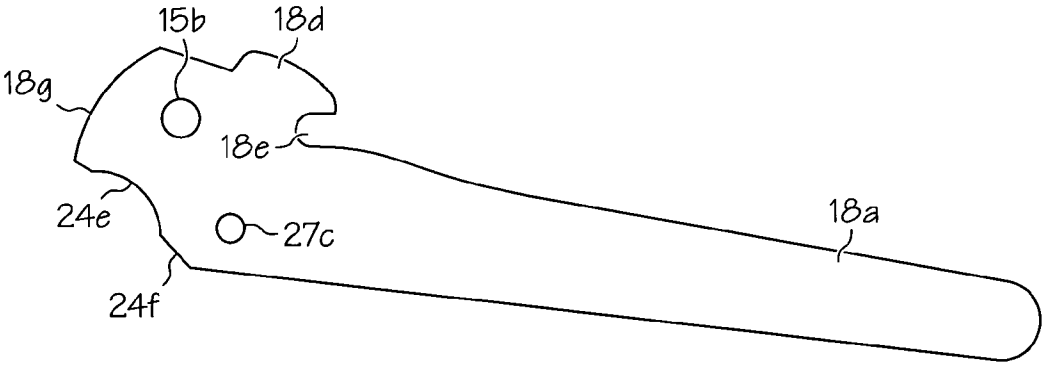
FIG. 3 illustrates a side view of a second complimentary handle portion that removably attaches a first handle portion, the blade holder assembly and a blade clamp assembly thereto according to the first preferred embodiment of the present invention.
Figure 4:
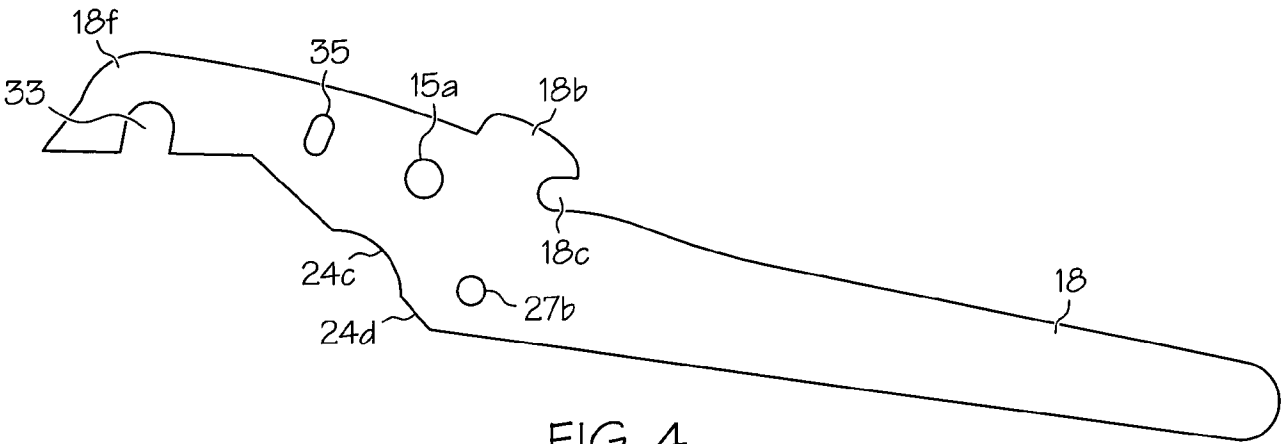
FIG. 4 illustrates a side view of a second handle portion that removably attaches the blade holder assembly, the blade clamp assembly and the complimentary second handle portion thereto according to the first preferred embodiment of the present invention.

FIGS. 3 and 4 show details of the handle portions 18 and 18*a* of the present invention. Note that FIG. 3 is different in shape and shorter in length than FIG. 4. However, there are some similarities and complimentary elements. They will now be discussed in greater details. Opening 15*a* of handle portion 18 shown in FIG. 4, opening 15*b* of handle portion 18*a* shown in FIG. 3 and opening 25 of the blade holder 24 shown in FIG. 2 align with one another to receive the threaded fastening element 15 for securing the handle portions 18 and 18*a* and the blade holder 24 sandwiched there between to allow the handle portions 18 and 18*a* and blade holder 24 to pivot together as a unit upon squeezing the handles together in one direction and releasing them in an opposite direction by a user. Also, spacer elements (not shown) are disposed between the handle portions 13 and handle portions 18 and 18*a* and secured together as single handle portions by fastening means (not shown).

In more detail, still referring to FIGS. 3 and 4, U-shape slot 18*c* as shown in FIG. 4 and u-shape slot 18*e* as shown in FIG. 3 are aligned with one another in the closed position of the cutter as shown in FIG. 1 to allow the latch member 16 to slid along the elongated opening 17 and into the u-shape slots 18*c* and 18*e* for latching the cutting tool or device into a latched closed position as depicted in FIG. 1. The complimentary indented or arcuate portions 24*c* and 24*e* as shown in FIGS. 3 and 4 are in alignment with the indented or arcuate portions 24*a* of the blade holder as shown in FIG. 2 in all positions of the cutting tool or device. This allows the handle portions to pivot in all positions without interference with the anvil member 23. Also, the inclined or slanted portion 24*b* as shown in FIGS. 1-2, inclined or slanted portion 24*d* as shown if FIG. 4 and the inclined or slanted portion 24*f* are aligned with one another, but inclined portion 24*b* extend forward more towards the anvil member 23. The reason for this is to minimize damage to the plastic anvil member 23. In both open positions of the cutting tool or device only the inclined or slanted portion 24*b* will come in contact with the anvil screw fastener 21 as the handle portions are pivoted and not the plastic anvil member 23 to mitigate damage to the anvil member 23. Note that pin openings 27*b* shown in FIG. 4 and pin opening 27*c* shown in FIG. 3 receives pin 27*a* therein, as well as, extending into the elongated pin opening 27 to permit the blade holder to move together with the handle portions 18 and 18*a*.

In further detail, still referring to FIGS. 3, the handle portion 18*a* has a snub end nose portion 18*g* that is machined to uncover the back side of the blade holder 24 that exposes the threaded openings 26 and 29 therein and the threaded fasteners 31 and 32 that received therein. FIG. 4 shows the full view of the elongated slot 35 that receives the screw fastener 31 therein. Also, FIG. 4 depicts a full view of the large U-shape slot 33 that receives the fastener 32 and the rubber gasket or O-ring 34 disposed thereabout.

Figure 5:
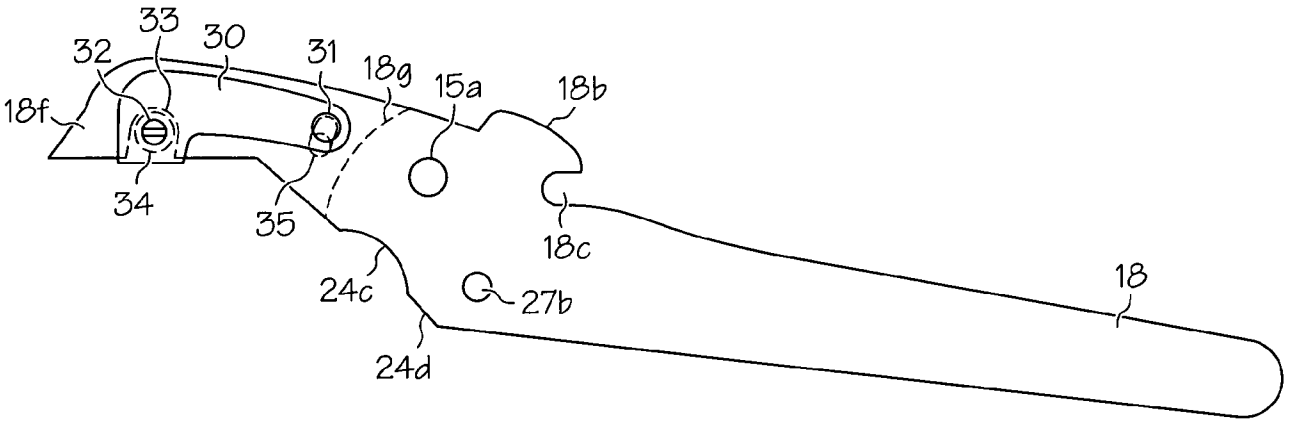
FIG. 5 illustrates another side view of the second handle portion with the blade clamp assembly attached thereto according to the first preferred embodiment of the present invention.

Turning now to FIG. 5, it shows every thing discussed above about FIG. 4 except for showing a full view of the clamp member 30 being attached to a front side of the front portion 18*f* of the handle portion 18. Note that the clamp member 30 is attached to front portion 18*f* by fastener 31 that moves up and down along elongated slot 35 and fastener 32 that receives the rubber gasket or O-ring 34 (shown in dotted lines) disposed thereabout in the large u-shape slot (shown in dotted lines).

Figure 6:
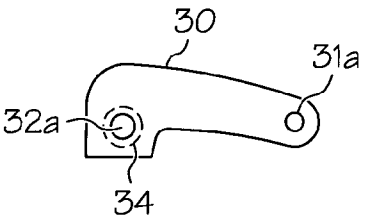
FIG. 6 illustrates a perspective side view of the blade holder clamp assembly according to the first preferred embodiment of the present invention.

FIG. 6 shows only the blade clamp member 30 with a screw threaded opening 31*a* for screw fastener 31 and a screw threaded opening 32*a* for screw fastener 32 as discussed above earlier. The rubber gasket or O-ring 34 is shown in dotted lines around threaded opening 32*a*.

Figure 7:
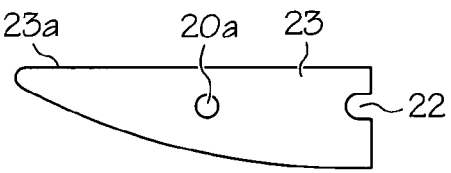
FIG. 7 illustrates a perspective side view of the anvil member according to the first preferred embodiment of the present invention.

FIG. 7 shows a full side view of the plastic anvil member 23 that includes a threaded opening 20*a* that receives screw fastener 20, an oversized U-shape slot 22 that receives screw fastener 21 and a flat anvil cutting surface 23*a*.

Figure 8:
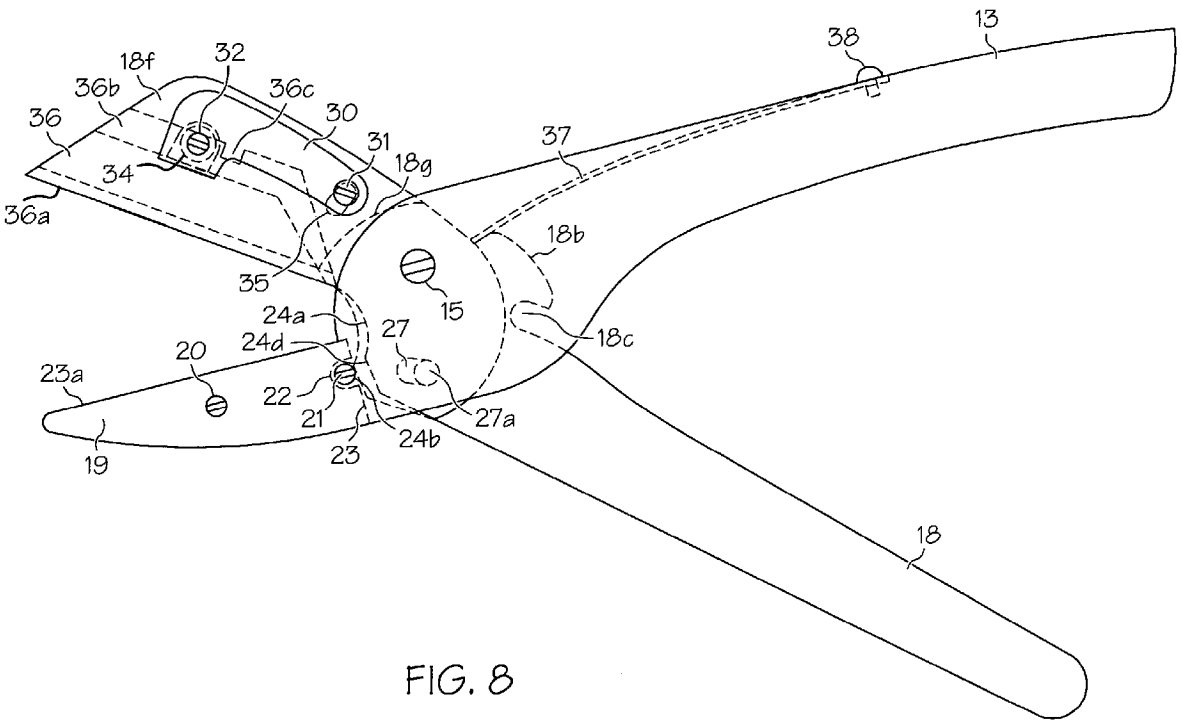
FIG. 8 illustrates a perspective side view of a fully open position of the standard blade and anvil type cutting tool or device with an integral non-tool blade changing blade holder assembly and a blade clamp assembly according to the first preferred embodiment of the present invention.
Figure 9:
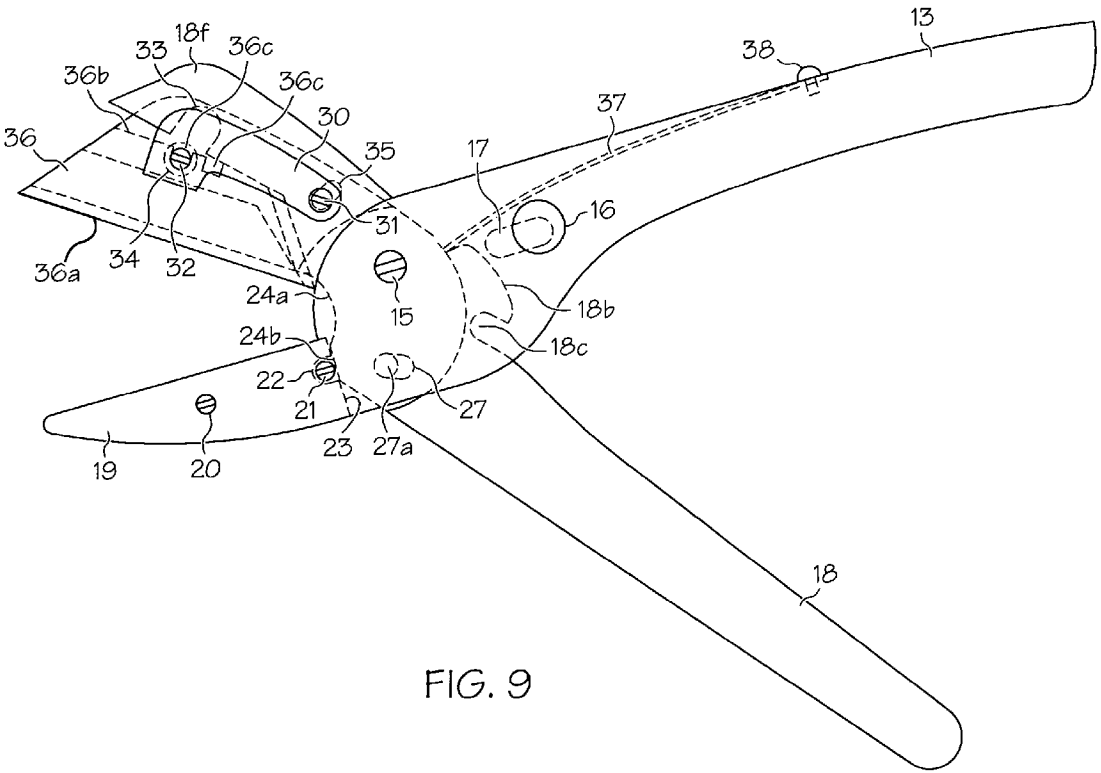
FIG. 9 illustrates another perspective side view of a second fully open release position of the standard blade and anvil type cutting tool or device with an integral non-tool blade changing blade holder assembly and a blade clamp assembly for enabling a standard blade to be easily changed without tools according to the first preferred embodiment of the present invention.

In more detail, still referring to the invention of FIG. 1, the cutting tool or device as shown in FIGS. 8 and 9 illustrates the plural open positions. Note that the same elements depicted here in FIG. 8, which were discussed in greater detail earlier, will not be repeated again. FIG. 8 shows a flat spring member 37 having one end in constant contact with the raised or fin-like element 18*b* of handle portion 18 and the raised or fin-like element 18*d* (see FIG. 3) of handle portion 18*a*. The other end of the spring is secured to the spacer element (not shown) that is secured between the handle portions 13 as discussed above by screw element 38. This spring automatically pivots the handle portions 13, 18 and 18*a* to the first open position when the latch member 16 is manually moved by a user along the elongated opening 17 and out of the u-shaped slots 18*c* and 18*e* for releasably unlatching the handle portions 13, 18 and 18*a*. This open position allows material or objects to be placed on the cutting surface 23*a* of the anvil member 23 to be cut.

FIG. 8 further shows the blade clamp member 30 in the upward position, where the pivot screw fastener 31 is moved to an upper end of the elongated slot 35 of the blade holder 24 and the rubber gasket or O-ring 34 about the screw fastener 32 is tightly secured or clamped within the large U-shaped slot to maintain the blade 36 within the cut-out section 28. The blade 36 has at least a pair of spaced U-shape receiving slots 36*c* at an upper portion 36*b* and the lower portion of the blade 36 has a cutting section 36*a*. The above tight securement is a direct result of one of the receiving slots 36*c* receiving the screw fastener 32 therein and being tightly wedged between the U-shape slot 33 of the blade holder 24 and the rubber gasket or O-ring 34. This clamp position is achieved when a user squeezes the handle portions towards one another so that the blade cutting section 36a is forced against the anvil cutting surface 23*a* so that the blade 36 moves upward with the blade clamp member 30 to the clamp position as described above.

In further detail, FIG. 8 shows the inclined portion 24*b* only engaging the screw fastener 21 in the first open position with the indented or arcuate portion 24*a* clears or is spaced from the anvil member 23 to reduce damage to the anvil member 23 as mentioned above.

Referring now to FIG. 9, the second open position for changing a standard blade 36 without tools will now be described. In order to move from the first open position to the blade changing second position the spring 37 will move further downward as a user pull the handle portions 13, 18 and 18*a* further outward until a click noise is heard or a click feel is felt. Once this is heard or felt, the inclined or slanted portion 24*b* will move slightly more in contact with the screw fastener 21 and the arcuate or indented portion 24*a* still clearing the anvil member 23 to further reduce damage to the anvil member 23. As the handle portions 13, 18 and 18*a* is pulled further outward as described above, the blade holder pin 27*a* will move to an opposite end of the elongated slot 27. This movement will move the blade holder 24 and the blade clamp downward. The downward movement allows the pivot screw 31 to move downward in the elongated slot 35, while simultaneously moving the rubber gasket or O-ring 34 and the screw fastener 32 out of the large U-shaped slot 33 to an unclamped position. In this position, the blade 36 is still tightly clamped within one of the receiving slots 36*c* by preventing the blade from flying out by the rubber gasket or O-ring 34. In this position, a user can easily grasped the existing standard blade pull it out of the receiving slot 36*c* and change it with another standard blade with out any tools. Once the new standard blade's receiving slot 36*c* receives the rubber gasket or O-ring 34 and the screw fastener 32 therein, a user will then pull the handle portions 13, 18 and 18*a* towards one another against spring 37 so that the blade cutting section 36*a* is forced against the anvil cutting surface 23*a* so that the blade 36 moves upward with the blade clamp member 30 to the clamp position as described above.

It is brought to the attention of one skilled in the art that various types of fasteners, such as screws, bolts and nuts, rivets, pins, to name just a few, could be utilized in the preferred first embodiment of the present invention. Also, different types and configurations of springs could be utilized in view of element 37.

The second preferred embodiment illustrated in FIGS. 10-24 will now be discussed. It is noted that the reference numerals of FIGS. 10-24 will be shown with a prime (') element, in which many of the reference numerals are the same as those shown in FIGS. 1-9 of the first preferred embodiment of the present invention. Note that FIGS. 10-24 depicts several modifications that are not a part of FIGS. 1-9 are described as follows:

a.) a double handle portions being stamped out of a single piece of metal material and folded to create double-sided handles with an open section underneath and a minor open section at a top surface thereon with the remaining upper portion being closed by the fold to be discussed in greater detail later.

b.) an elongated latching button member with gripping and sliding elements.

c.) an upper anvil cutting surface being of a height higher than the front anvil section of the first handle portion.

d.) a stamped raised reinforcing element on the front anvil section.

e.) a pair of hand gripping covers on the first and second rear end double-sided gripping portions with at least on the hand gripping covers including a sliding tray for storing additional razor blades therein.

f.) a downward extending inclined surface at a selected distance from the rear end of the first handle gripping end.

g.) a guide and alignment element at a lower front end of the blade clamp assembly.

h.) A blade holder having a pair of inclined or slanted surfaces along a front portion and an indented surface along a rear portion thereof.

Figure 10:
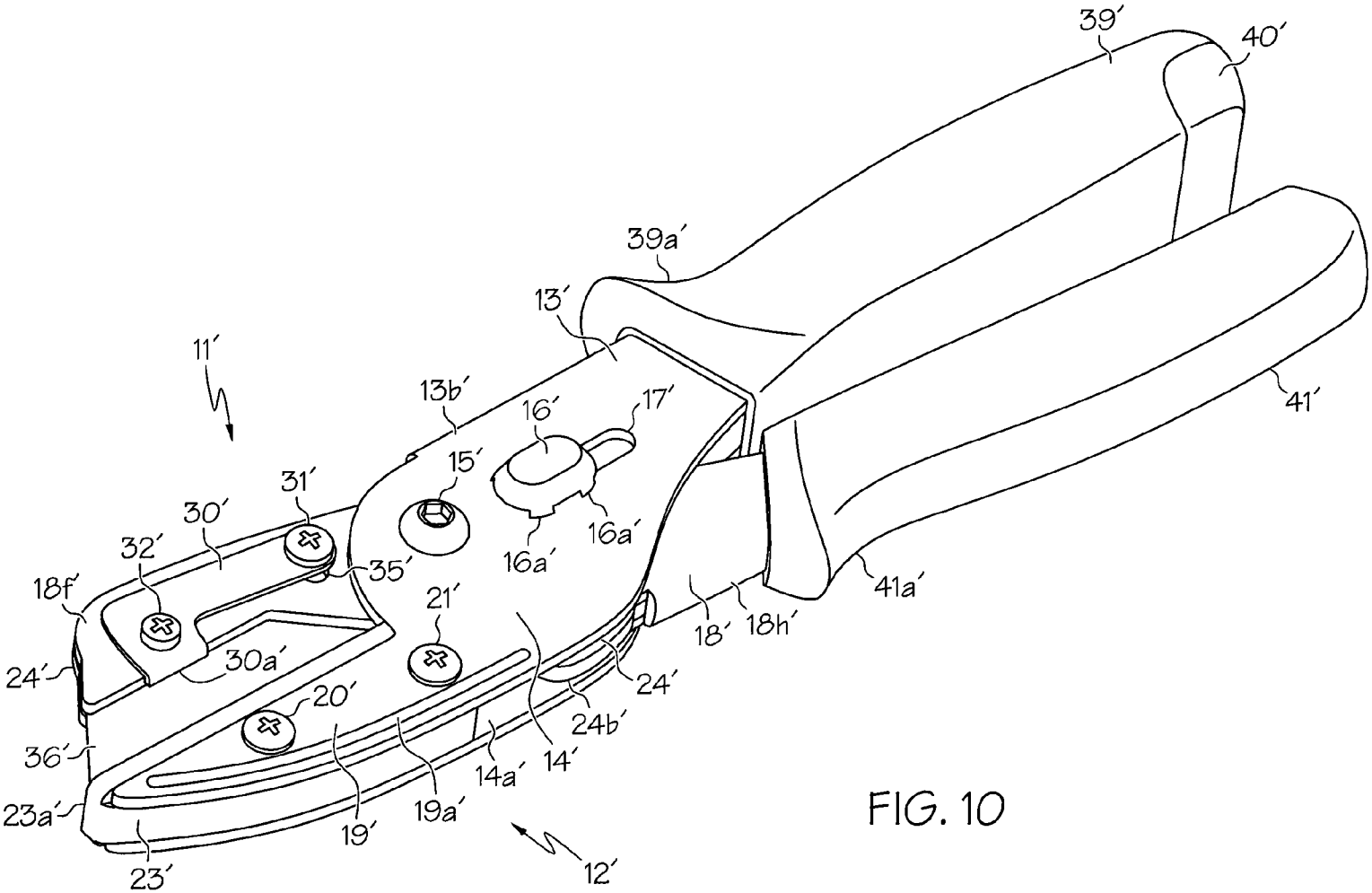
FIG. 10 illustrates an isometric view of a closed position of a standard blade and anvil type cutting tool or device with an integral non-tool blade changing blade holder assembly and a blade clamp assembly with handle gripping members according to a second preferred embodiment of the present invention.
Figure 10A:
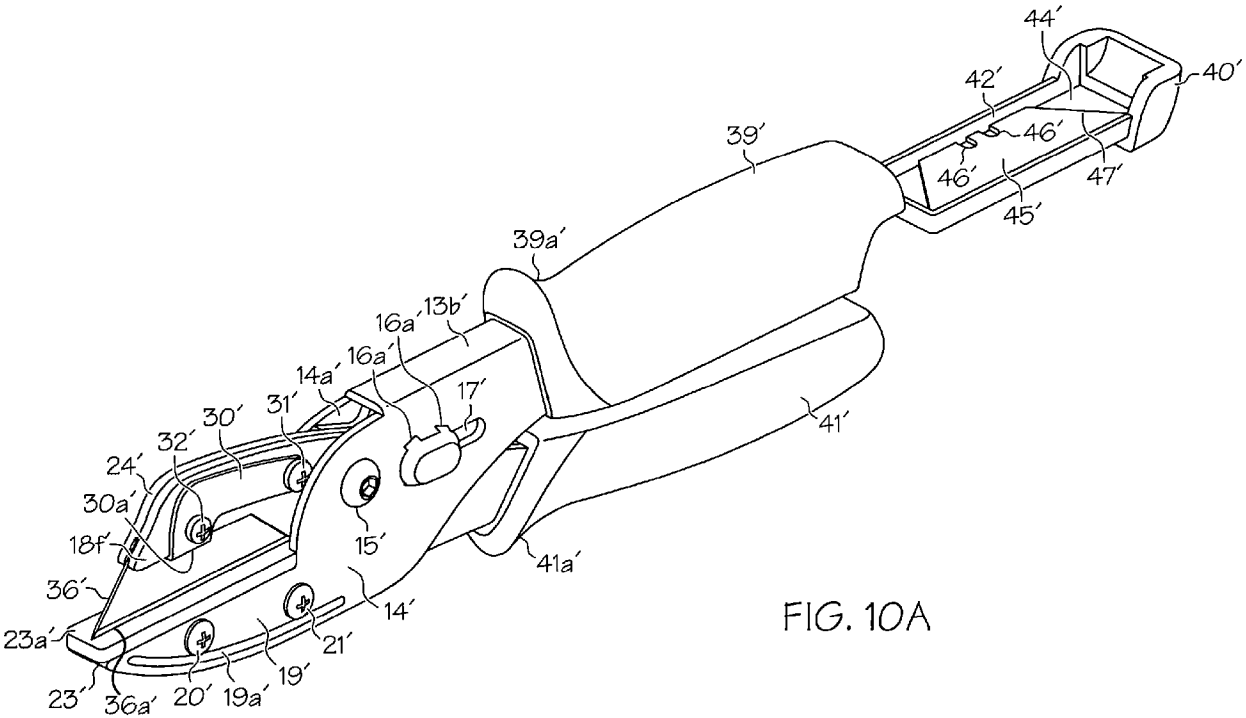
FIG. 10A illustrates a perspective side view of a closed position of the standard blade and anvil type cutting tool or device with an integral non-tool blade changing blade holder assembly and a blade clamp assembly with a sliding razor blade storage tray within one of the handle gripping members according to the second preferred embodiment of the present invention.

Turning now to FIGS. 10-23 of the drawings, they show various modifications of the second preferred embodiment of the present invention as discussed above of a utility cutter. In FIGS. 10 and 10A, the utility cutter has a first handle portion 13' with a blade holder assembly and a blade clamp assembly 11' connected thereto and a second handle portion 18' with an anvil assembly 12' connected thereto. The first handle portion 13' and the second handle portion 18' are made out of sheets of stamped metal material and folded to form a single handle member with double-sided complimentary sections. Note that the folding creates open portions 14*a'* between the double-sided complimentary sections. The first handle portion 13' open portions 14*a'* opens along a bottom portion thereof and extends from a front anvil section 19' to a rear gripping end that is covered by a handle gripping cover 39' with a sliding razor blade storage tray 40' therein. A hand support and stop member 39*a'* being disposed at a forward end of the hand gripping cover 39'. The hand support and stop member limits a user hand from sliding forward and provide a comfort support for the area between the thumb and the index finger when the first handle portion 13' is gripped to be moved between open and closed positions. A top portion of the handle portion 13' has a top folded portion 13*b'* that extends from the rear gripping end to an intermediate section 14' with an upper open portion 14*a'* extending from the intermediate section 14' to a front anvil section 19' of the double-sided complimentary sections. In FIG. 10A, the sliding tray 40' defines a front grasping portion for moving the sliding tray 40' inward and outward of the of the gripping cover 39' of the handle portion 13' to gain access to stored blades 45'. The stored blades 45' are housed within a compartment space 44' within the sliding tray 40'. These blades have a pair of adjustment slots at an upper portion of the blades 45' for selectively changing the utility cutter 11' and 12' between a standard knife type cutting and a blade-and-anvil type cutting. Also, the sliding tray 40' has a pair of side portions 42' that will slide along and engage a complimentary mating surface on the inside of the gripping cover 39' and a forward end that will engage or abut a stop surface 13*a'* on the handle portion 13' as shown in FIG. 16 when the tray is fully inserted within hand gripping cover 39'. Each end of the blade 45' has a pair of slanted ends 47'.

Still referring to FIGS. 10 and 10A, the double-sided complimentary front anvil sections 19' includes a pair of securing openings 20*a*' and 21*a*' for receiving screw fasteners 20' and 21' there through and an anvil member 23' with screw fastener openings 20*a*' and 22' that receive screw fasteners 20' and 21', an anvil cutting surface 23*a*' (see FIG. 18) and a raised stamped reinforcing element 19*a*' that extends from a front end of the anvil double-sided complimentary sections to the double-sided complimentary intermediate sections. This reinforcing element 19*a*' is stamped into the sheet of metal material prior to being folded into a single first handle member 13'. Such reinforcement strengthens the double-sided complimentary anvil sections 19' during cutting of materials or objects on the cutting anvil surface 23*a*'. The screw fasteners 20' and 21' secures the anvil member 23' within the front anvil complimentary sections 19' together to further establish the first handle portion 13'. The anvil member screw fastener opening 22' has a U-shape slot configuration The U-shaped slot 22' allows the anvil 23' to slightly pivot or move about screw fastener 21 while adjusting or screwing screw fastener 20' in screw fastener opening 20*a*'. This makes sure that the anvil member 23' is always properly aligned.

The intermediate section 14' includes an elongated opening 17' and a pivotal securing opening 15*b*' (see FIG. 16) for receiving a pivotal and securing screw 15'. The screw 15' has a screw end (not shown) that extends through opening 15*b*' of one of the double-sided complimentary intermediate sections through another opening 15*b*' (not shown) of the other double-sided complimentary intermediate sections. In the intermediate section 14', an elongated sliding button latching member 16' with an end extending into the elongated opening 17' from one side of one of the double-sided complimentary sections with another elongated button latching member 16' (not shown) with an end extending into a complimentary elongated opening 17' (not shown) from the other side of the other double-sided complimentary sections so that the elongated button latching member ends are cooperatively secured to one another. As shown in FIGS. 10 and 10A the elongated button latching members 16' have a pair of spaced apart leg elements 16*a*' on opposite sides thereof. These leg elements 16*a*' will slide on the double-sided complimentary intermediate sections 14' along the elongated openings 17'. Also, the leg elements 16*a*' allow a user be able to easily grip the elongated button latching members 16'. Note that the cooperatively securing of the elongated button latching member ends together can take on various types of fastening means that is obvious to one of ordinary skill in the art at the time that the invention was made.

The various types of securing means as stated above can be a self-threaded fastening screw (not shown) that screws through one of the ends and into the other end to secure the complimentary elongated latching button members 16' within the complimentary elongated openings 17'. One of the elongated button members 16' could have a recessed opening (not shown) in the center of the elongated button member 16' so that a screw head (not shown) of the self-threaded fastening screw (not shown) is flush within the recessed opening (not shown), if desired. Also, the complimentary ends could have snap-fitted ends with mating spring-loaded and recess detent elements or a plastic raised rib and rib recess detents disposed on opposite complimentary ends thereby engaging one another when a portion of one end is inserted within the other end. Another securing means could be a single screw that from one button member to the other button member. Each button member 16' would have a recess (not shown) within the center thereof, with a screw head being flush within one recess and the opposite screw end being flush within the other recess (not shown). If desired, a small nut washer could be utilized on a screw end with the recess (not shown) opposite the screw head (not shown). Note that these are just a few of the many types of securing means that could be utilized.

The second handle portion 18' open portions 14*a*' opens along a top portion thereof and extends from a front handle portion 18*f*' to a rear gripping end that is covered by a handle gripping cover 41' with a hand support and stop member 41*a*'. The hand support and stop member 41*a*' stop a user hand from sliding forward and provide a comfort support for the area between the thumb and the index finger when the second handle portion 18' is gripped to be moved between open and closed positions. A bottom portion of the handle portion 18' has a folded portion 18*h*' that extends from the rear gripping end to a selected distance that is in close proximity to the intermediate section 14' of the first handle portion 13' with an upper open portion 18*i*'.

Furthermore, FIGS. 10 and 10A, has another complimentary handle portion 18' (not shown) that is shorter than the other complimentary handle portion 18' that extends from the front handle portion 18*f*' to the rear gripping end that is covered by the handle gripping cover 41'. The shorter complimentary handle portion 18' has a front end (not shown) that extends from the intermediate section 14' of the first handle portion 13' and to the complimentary rear gripping end that is covered by a handle gripping cover 41'. Note that the upper open portion 18*i*' extends to the bottom of the second handle complimentary portions 18' between the folded portion 18*h*' adjacent the intermediate section 14' ends and the front end of the shorter complimentary handle portion 18'. A latching U-shaped slot 18*c*' and a raised or fin-like element 18*b*' are disposed intermediate the front portion 18*f*' and an end of handle portions 18'. Note that element 17' will receive latching member 16' therein when the handle portions 13' and 18' are moved to a closed position as shown in FIGS. 10 and 10A and latching member 16' is moved into U-shaped slots 18*c*' (see FIG. 15) and elongated opening 17' to the latched open positions as shown in FIGS. 11-14.

Still relating to FIGS. 10 and 10A., a blade holder 24' and a blade clamp member 30' are attached to the front handle portion 18*f*' by a plurality of screw fasteners 31' and 32' through an elongated slot 35' and a U-shaped slot or opening 33', respectively. A lower end of the blade holder 24' has a fastener openings 25' for receiving the pivotal and securing screw 15' and an elongated opening 27' (see FIG. 17) and a pin element 27*a* (see FIG. 1) movable therein to allow the blade holder 24' to move together with the complimentary second handle portions 18' relative to the complimentary first handle portions 13'. The blade holder 24' includes a pair of inclined or slanted portions 24*a*' and 24*b*' extending there from (see FIG. 17) along a front surface and an indented portion 24 *c*'along a rear surface thereof. This indented portion 24*c*' makes sure that the blade holder has no interference with the latch member 16' when the handle portions 13' and 18' are moved to a latched closed position. The blade holder 24' is sandwiched between the first and second complimentary handle portions 13' and 18'. The blade clamp member 30' has a lower bent or turned up end below fastener screw 32' to provide a guide and alignment member 30*a*' to make sure that the razor blade 36' is aligned properly within fastener opening 33' that receives fastener 32' therein so that the razor blade cutting edge 36*a*' will always be properly positioned and aligned for a cutting relationship with the anvil cutting surface 23*a*'. Further details of the blade holder 24' and the blade clamp member 30' will be discussed later.

Figure 11:
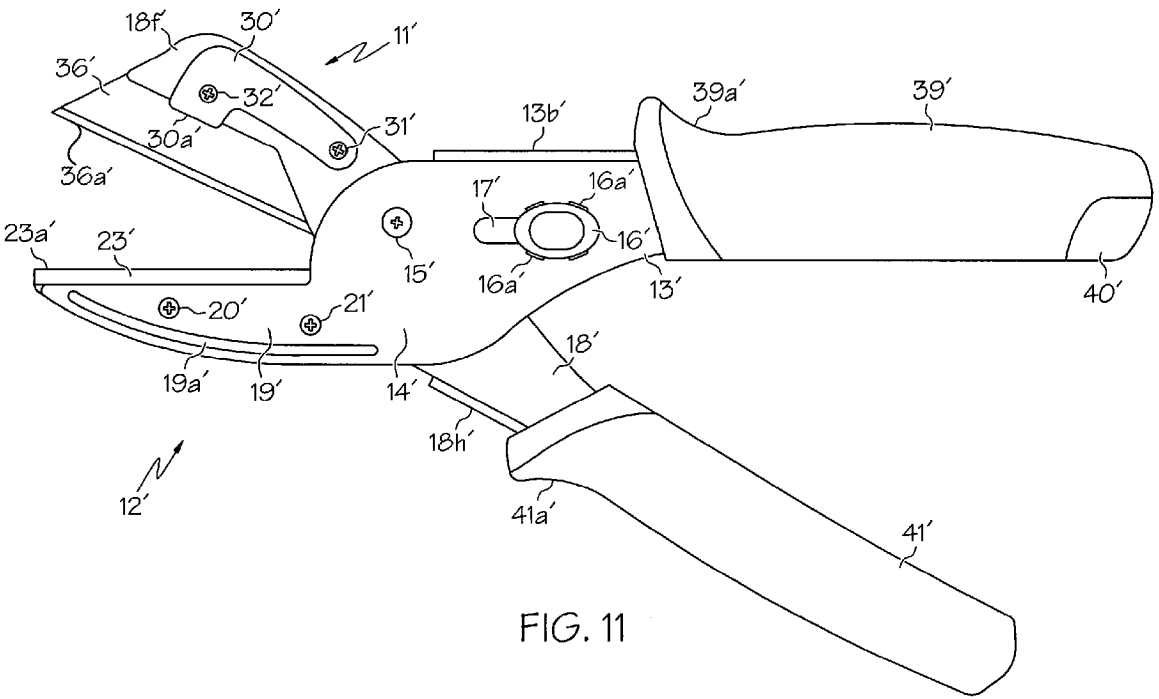
FIG. 11 illustrates a perspective side view of a fully open position of the standard blade and anvil type cutting tool or device with an integral non-tool blade changing blade holder assembly and a blade clamp assembly with the handle gripping members according to the second preferred embodiment of the present invention.
Figure 12:
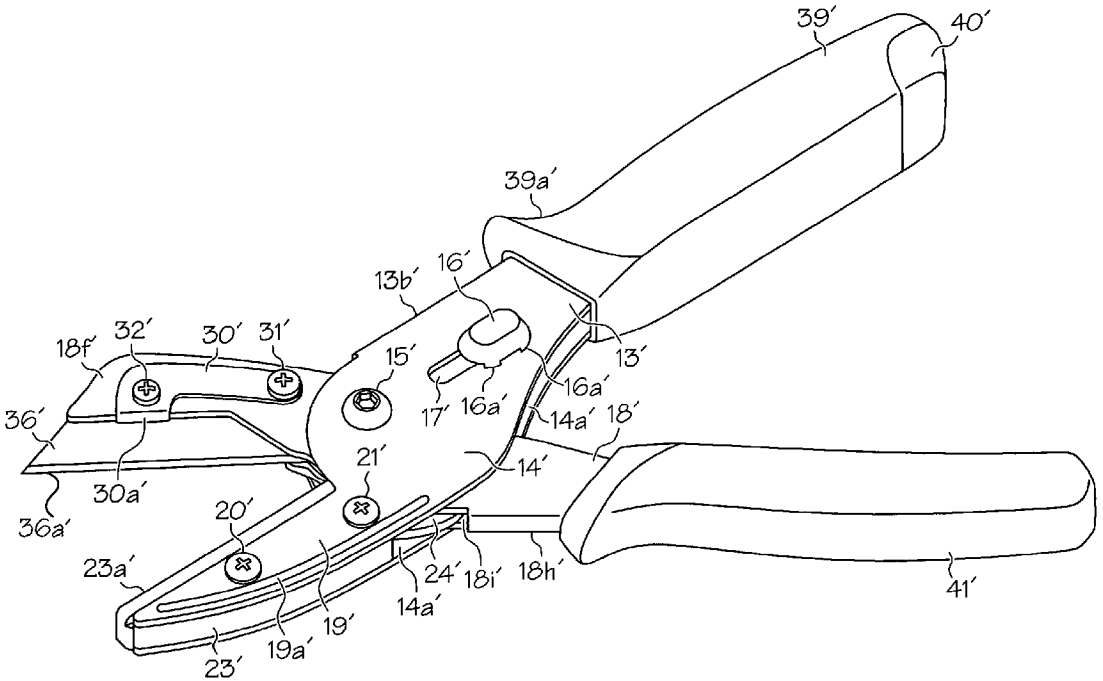
FIG. 12 illustrates an isometric view of a fully open position of the standard blade and anvil type cutting tool or device with an integral non-tool blade changing blade holder assembly and a blade clamp assembly with the handle gripping members according to the second preferred embodiment of the present invention.

FIGS. 11 and 12 illustrates the second preferred embodiment in a first open position to allow materials or objects to be placed on the anvil cutting surface 23*a*' with latching button member 16' being moved along the elongated opening 17' opposite the closed position and the movement of pin 27*a*' within blade holder opening 27' to a first open position (see FIG. 8 for illustration purposes) to enable a user to move the first and second handle portions 13' and 18' away from one another. No further description of FIGS. 11 and 12 will be discussed in order to eliminate the redundancy of describing the same elements.

Figure 13:
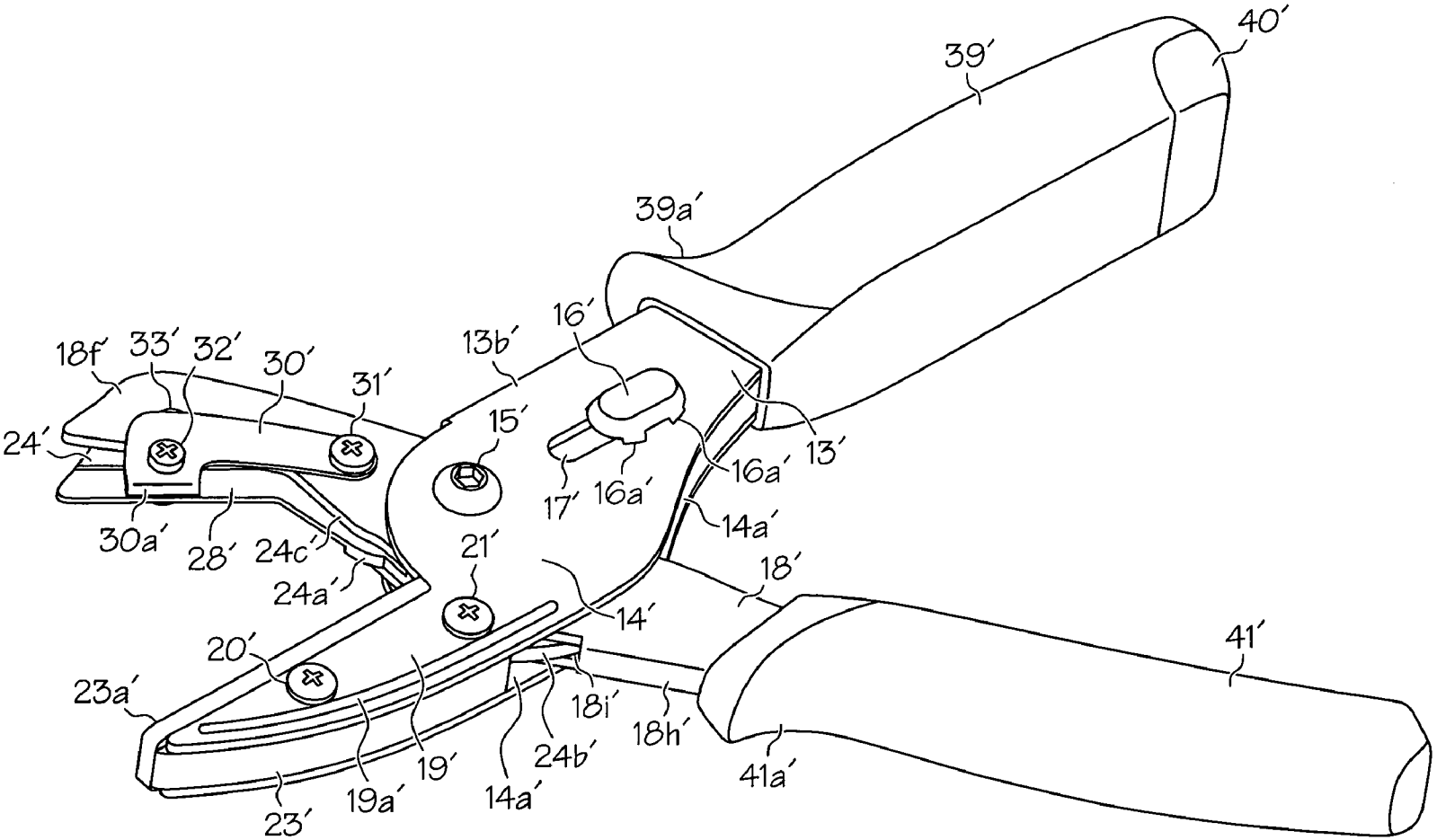
FIG. 13 illustrates an isometric view of a fully open release position of the standard blade and anvil type cutting tool or device with an integral non-tool blade changing blade holder assembly and a blade clamp assembly with the handle gripping members for enabling a standard blade to be easily changed without tools according to the second preferred embodiment of the present invention.
Figure 14:
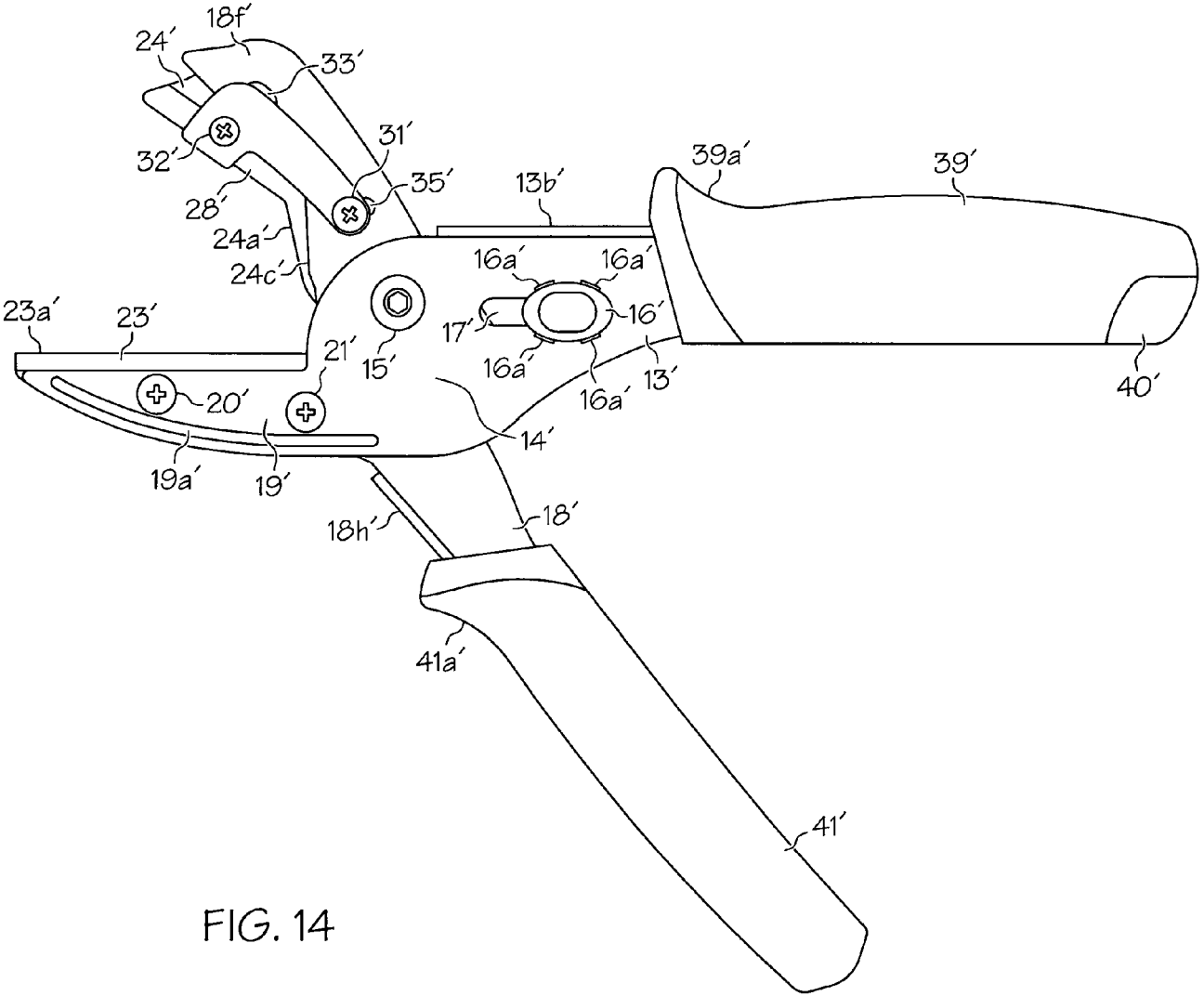
FIG. 14 illustrates a perspective side view of a fully open release position of the standard blade and anvil type cutting tool or device with an integral non-tool blade changing blade holder assembly and a blade clamp assembly with the handle gripping members for enabling a standard blade to be easily changed without tools according to the second preferred embodiment of the present invention.

FIGS. 13 and 14 illustrates the second preferred embodiment in a second open position to allow razor blade 36' to be changed easily with a user hand and without the use of tools. In the isometric view as shown in FIG. 13, the latching button member 16' remain in the same position within the elongated opening 17' as it was when the handle portions 13' and 18' was moved to a first open position. However, additional movement is achieved by movement of pin 27*a*' within the blade opening 27' to a second open position (see FIG. 9 for illustration purposes) to enable a user to move the first and second handle portions 13' and 18' further away from one another allowing the screw fastener 32' and gasket 34 (see FIGS. 8 and 9) to move away from the U-shaped clamp fastening opening 33'. This unclamps the blade within the clamp U-shaped clamp fastening opening 33' for easy blade removal without tools. As illustrated in FIG. 13, a major portion of the blade holder 24' extends out through the upper open portion 14*a*' of the double-sided complimentary intermediate sections 14'of the first double-sided handle portion 13'. A lower portion of the blade holder 24' defining slanted portion 24*b*' is disposed in the lower open portion 14*a*' of the complimentary double-sided intermediate sections 14' adjacent the rear end of the anvil member 23'. Note that the slanted portion 24*b*' is designed to always clear the screw 21' to prevent damaged thereto when the blade holder is moved between open and closed positions of the utility cutter. The lower remaining portion of the blade holder 24*b*' is disposed within the lower open portion 18*i*' between the complimentary double-sided second handle portion 18' and is held therein by the pivotal screw 15' of the intermediate complimentary sections 14'.

The perspective side of FIG. 14 shows many of the same elements as shown in the isometric view of FIG. 13. However, FIG. 14 shows that the screw 31' of the blade clamp member has moved from a top portion of the elongated slot 35' to a lower portion thereof after the first and second complimentary handle portions 13' and 18' have moved to the second open position. During the same movement, the screw 32' moves downwardly away or out of the U-shaped slot 33' allowing the blade clamp member 30' to move or pivot relative to the screw 31' to unclamp the razor blade 36' by for easy removal without the use of any tools. This unclamping action is achieved by a user grasping a portion of the razor blade 36' and pulling it downward, so that the blade adjustment slot 36 is pulled away from gasket 34' (not shown, but shown in FIGS. 1, 5-6 and 8-9) and screw fastener 32' along the guide and alignment element 30*a*' of the blade clamp member 30'. Furthermore, no additional features of FIG. 14 will be discussed since they have already been explained in the description of FIG. 13 above.

Figure 15:
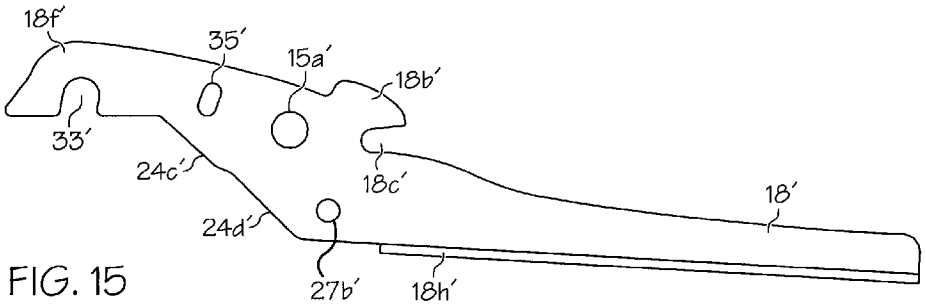
FIG. 15 illustrates a side view of a modified second handle portion that removably attaches the blade holder assembly, the blade clamp assembly and the complimentary second handle portion thereto according to the second preferred embodiment of the present invention.
Figure 16:
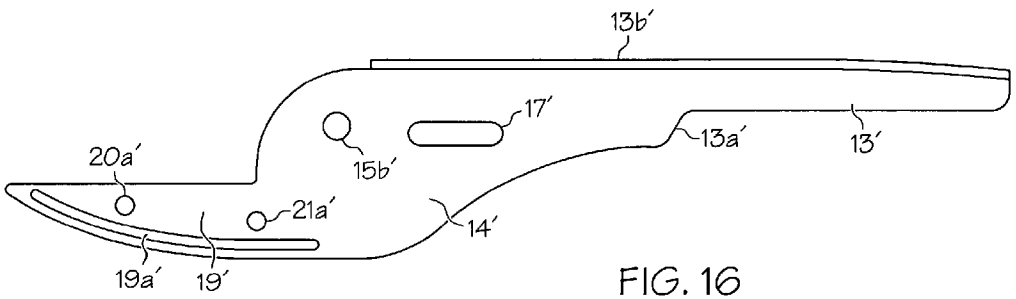
FIG. 16 illustrates a side view of a modified first handle portion that removably attaches to the second handle portion and a modified anvil member with a reinforced member thereon according to the second preferred embodiment of the present invention.

Referring now to FIG. 15, the second handle portion 18' will now be described. The second complimentary handle portion 18' depicts a side view of one side thereof. This handle portion 18' has a rear gripping section with a U-shaped slot 18*c*' defined by a raised or fin-like element 18*b*' disposed intermediate the front portion 18*f*' and a rear gripping end of the complimentary handle portions 18'. The complimentary U-shaped slots 18*c*' being aligned to allow the latch member 16' to slid along the elongated opening 17' into and out of the U-shaped slots 18*c*' for latching and unlatching the blade and anvil type cutting tool or device defined by referenced elements 11' and 12' between closed and open positions in the same manner as illustrated in FIGS. 1, and 8-9. Note that the other complimentary second handle portion 18' not shown is shorter in length with a front end (not shown) that extends from the intermediate section 14' of the first handle portion 13' and to the complimentary rear gripping rear end thereof. The side view of the second handle portion 18' has a plurality of slots and openings disposed thereon and extending from the front end 18*f*' to an intermediate section that is contiguous with the raised or fin-like element 18b' and the U-shaped latching slot 18*c*'. Near the front end 18*f*' is the U-shaped slot 33' for receiving the blade clamp screw fastener 32' and the rubber gasket or O-ring 34' disposed thereabout. Next is the elongated opening 35' that receives the pivotal or movable blade clamp fastener 31'.

The next opening 15*a*' receives the pivotal screw 15' that pivotal secures the first handle portion 13' and the second handle portion 18' together as a pivotal unit. Also, the last opening is defined as 27*b*' that receives the pin 27*a* that is in moving engagement with the elongated slot 27' of the blade holder member 24'. See FIGS. 1-2 and 8-9 for better illustrations of how the above slots and openings interact with the blade clamp 30', blade holder 24' the first handle portion 13' and the second handle portion 18'. The bottom portion of the handle portion 18' has a folded portion 18*h*' that extends from the rear gripping end to a selected distance that is approximately located below the raised or fin-like element 18*b*' and the U-shaped latching slot 18*c*', as well as, being in close proximity to the intermediate section 14' of the first handle portion 13'. Furthermore, the folded section 18*h*' defines an upper open portion 18*i*' in between the complimentary handle portions 18'. Finally, the side view of handle portion 13' includes a pair of slanted surfaces 24*c*' and 24*d*' disposed along an intermediate edge between the slot 33' and a bottom portion of the handle portion 13' just below opening 27*b*'.

In FIG. 16, a side view of the first complimentary handle portions 13' illustrates the double-sided front anvil sections 19' with a pair of securing openings 20*a*' and 21*a*' for receiving screw fasteners 20' and 21' there through and an anvil member 23' with screw fastener openings 20*a*' and 22' that receive screw fasteners 20' and 21', an anvil cutting surface 23*a*' (see FIG. 18) and a raised stamped reinforcing element 19*a*' that extends from a front end of the anvil double-sided complimentary sections to the double-sided complimentary intermediate sections. This reinforcing element 19*a*' is stamped into the sheet of metal material prior to being folded into a single first handle member 13'. Such reinforcement strengthens the double-sided complimentary anvil sections 19' during cutting of materials or objects on the cutting anvil surface 23*a*'. The screw fasteners 20' and 21' secures the anvil member 23' within the front anvil complimentary sections 19' together to further establish the first handle portion 13'. The anvil member screw fastener opening 22' has a U-shape slot configuration The U-shaped slot 22' allows the anvil 23' to slightly pivot or move about screw fastener 21 while adjusting or screwing screw fastener 20' in screw fastener opening 20*a*'. This allows for the anvil member 23' to always be properly aligned between the complimentary anvil sections 19'. An under surface of the first handle portions 13' includes a downward and slanted stop member 13*a*' that serves the purpose of stopping a forward end of the sliding razor blade storage tray 40' and providing clearance between the undersurface of the first handle portions 13' and the sliding razor blade storage tray space 44' when the gripping cover 39' is fully inserted on the first handle portions 13'.

Figure 17:
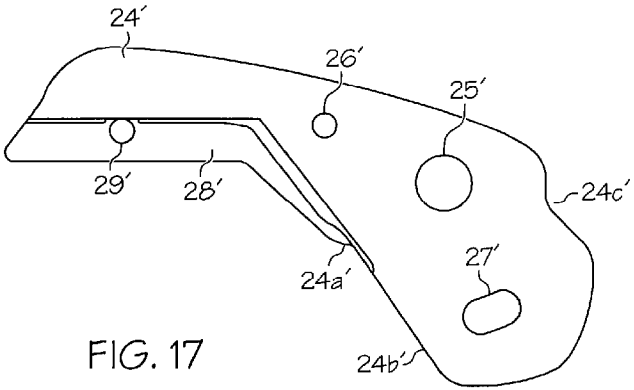
FIG. 17 illustrates a perspective side view of a modified blade holder assembly according to the second preferred embodiment of the present invention.

FIG. 17 illustrates a side view of the blade holder 24'. The blade holder 24' includes the elongated pin opening 27' and a pivot fastening opening 25' for receiving the pivotal and securing screw 15' that is disposed through the complimentary fastening opening 25' within the complimentary intermediate securing sections 14' with the screw end of the pivotal and securing screw 15' receiving a threaded nut or fastener element (not shown) for pivotally securing the spaced apart handle portions 13' and 18' together to permit the handle portions 13' and 18' to pivot relative to one another between open and closed positions. The blade holder also includes a screw fastening opening 26' that will receive the fastening screw 31 through a screw fastening opening 31*a*' of blade clamp member 30' which will bottom out in screw fastening opening 26. Also, the fastening screw 31' will move along an elongated slot 35 in a front portion 18*f*' of handle portion 18' (see FIGS. 5, 8 and 9 for more details) to allow the clamp member 30' to pivot up and down between the first and second open positions. The blade holder 24' further includes upper and lower angled cut-out portions 28' defining a receiving portion for an upper blade portion 36*b*' (not shown, but see FIGS. 8 and 9). The upper angled portion having a pair of downward extending slanted portions 24*a*' and 24*b*' that are substantially at the same angle. However, slanted portion 24*a* is slanted a little more than slanted portion 24*b*'. Slanted portion 24*b*' extends down to a bottom lower rounded portion of the blade holder 24'. The downward portion of the lower end of the lower angled cut-out portion 28' intersects at point in between the pair of slanted portions 24*a*' and 24*b*'. A forward end of the upper and lower angled cut-out portions 28' extend to the front portion of blade holder 24'. Note that the cut-out section 28' is machined into a side portion of blade holder 24' at a depth to fully receive an upper portion and a side portion of a complimentary shaped standard cutting blade 36'. Within the cut-out section 28' near a front edge of the front portion of blade holder 24' a screw opening 29' is disposed therein to receive the screw fastener 32' for securing the other end of the clamp 30' to the front portion of blade holder 24' spaced from the screw fastener opening 26' that receives screw fastener 31'. Furthermore, a blade upper surface has an indented or arcuate portion 24*c*' at location adjacent a lower end thereof that connects to the bottom of the lower rounded portion. This indented or arcuate portion 24*c*' serves the purpose of clearing the latching button member 16' during movement of the double-sided first handle portion 13' and the double-sided second handle portion 18' between open and closed positions. The remaining upper portion extends from a forward end of the indented portion 24' to the front end of blade holder 24'.

Figure 18:
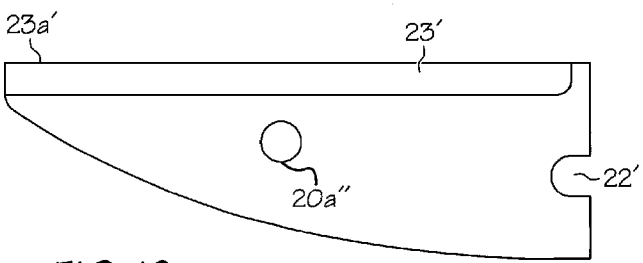
FIG. 18 illustrates a perspective side view of the modified anvil member according to the second preferred embodiment of the present invention.

FIG. 18 illustrates a side view of the plastic anvil member 23' The anvil member 23' includes a threaded opening 20*a*' that receives screw fastener 20', an oversized U-shaped slot 22' that receives screw fastener 21 and a flat anvil cutting surface 23*a*' with an upper portion having a height that extends above the complimentary anvil sections 19'. This provides an additional reinforcement when material or objects are being cut on the flat anvil cutting surface 23*a*'. The plastic flat surface 23*a*' allows for easy and nice even cutting, as well as, reducing the dulling of the razor blade 36' to thereby eliminate frequent changing of the razor blade 36'.

Figure 19:
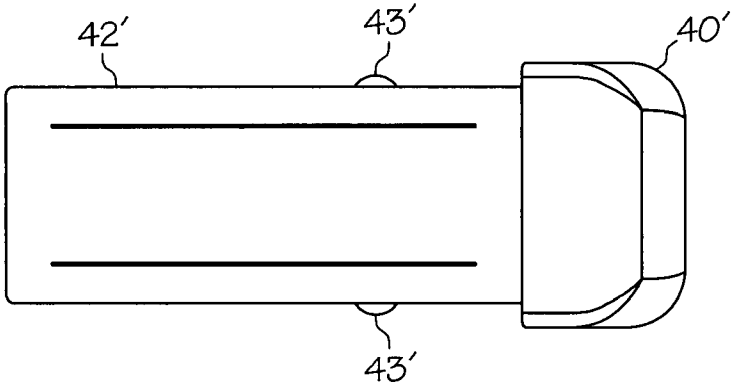
FIG. 19 illustrates a perspective top view of a sliding storage razor blade tray with tray retention spring members according to the second preferred embodiment of the present invention.
Figure 20:
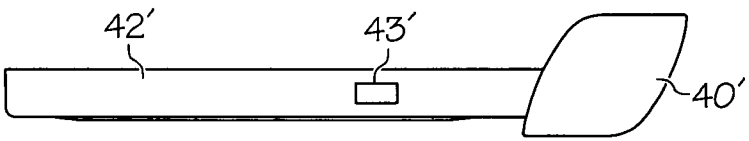
FIG. 20 illustrates a perspective side view of the sliding storage razor blade tray with the tray retention spring members according to the second preferred embodiment of the present invention.
Figure 21:
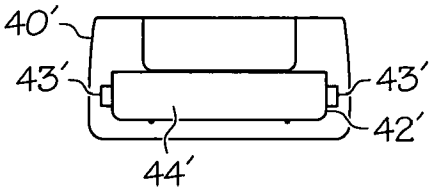
FIG. 21 illustrates a cross-sectional front view of the sliding storage razor blade tray with the tray retention spring members according to the second preferred embodiment of the present invention.

FIGS. 19-21 show different views of the sliding blade storage tray 40'. FIG. 19 illustrates a top view of the sliding blade tray 40' defining the grasping portion that allows a user to move the sliding storage tray inward and outward to gain access to the stored blades 45' within compartment space 44'. Note that the dark black lines represent the space 44'. The sliding tray sides 42' include a pair of spring-biased detents 43' disposed on opposite sides thereof for engaging a complimentary retention or detent surface inside the gripping cover 39' of the handle portion 13' for releasably locking or latching the sliding tray 40' therein.

FIG. 20 shows a side view of the sliding tray 40' with the front grasping portion for moving the sliding tray 40' inward and outward of the of the gripping cover 39' of the handle portion 13' to gain access to stored blades 45'. Also, the sliding tray sides 42' show the aforementioned spring-biased detents 43'.

FIG. 21 is a front cross-sectional view along the grasping portion that shows the sides 42' with the pair of spring-biased detents that engages detent surfaces that will engage the retention or detent surfaces within the gripping cover 39'. Also, FIG. 21 shows the razor blade storage compartment space 44' within the sliding tray 40'.

Figure 22:
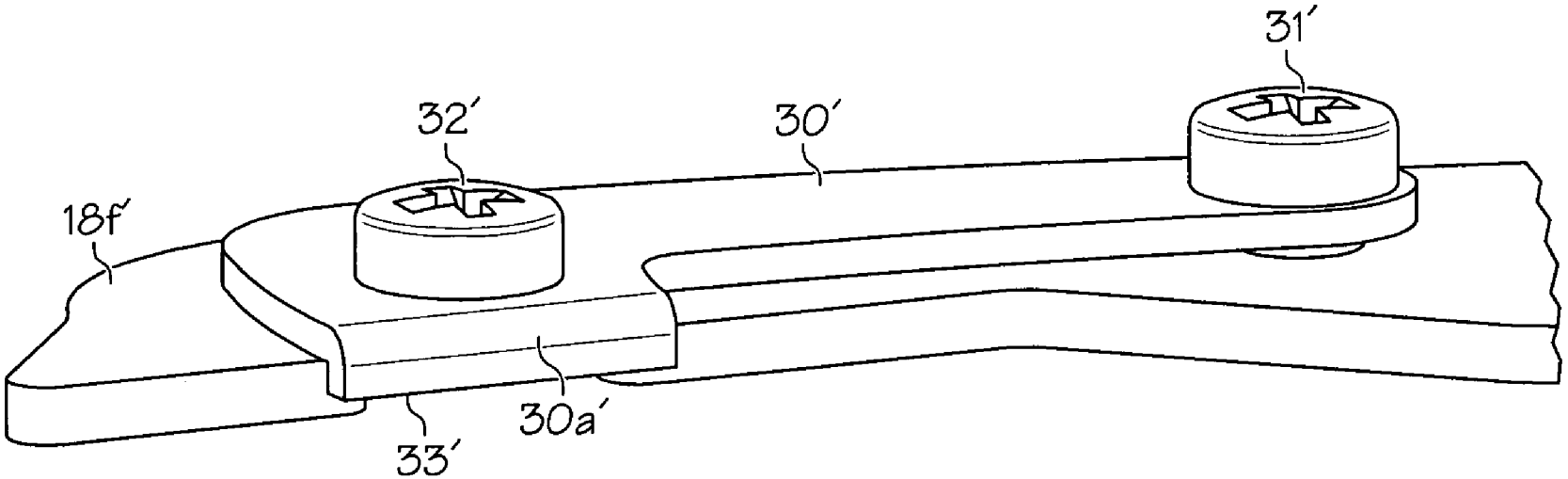
FIG. 22 illustrates a cross-sectional view of the modified blade holder assembly with an isometric side view of a modified blade clamp assembly with a guide element thereon according to the second preferred embodiment of the present invention.

FIG. 22 shows a side cross-sectional and isometric view of the modified blade holder 24' with a portion of the U-shaped slot 33' at the front portion of 18*f*' and the blade clamp member 30' is shown with the screw fasteners 31' and 32' and the bent and down turned alignment and guide element 30*a*' that abuts a portion of a bottom surface of the blade holder 24' and overlying a portion of the U-shaped slot 33' so that the blade 36' will be guided along the guide element 30*a*' and maintained on the right side of the gasket or O-ring 34' as the selected adjustment slot 36*c*' or 46' is inserted about screw fastener 32'. This allows the blade 36' or 46' to be clamped securely or tightly between the clamp member 30' and the gasket 34' at all times until the handle portions 13' and 18' have been moved to the second open position.

Figure 23:
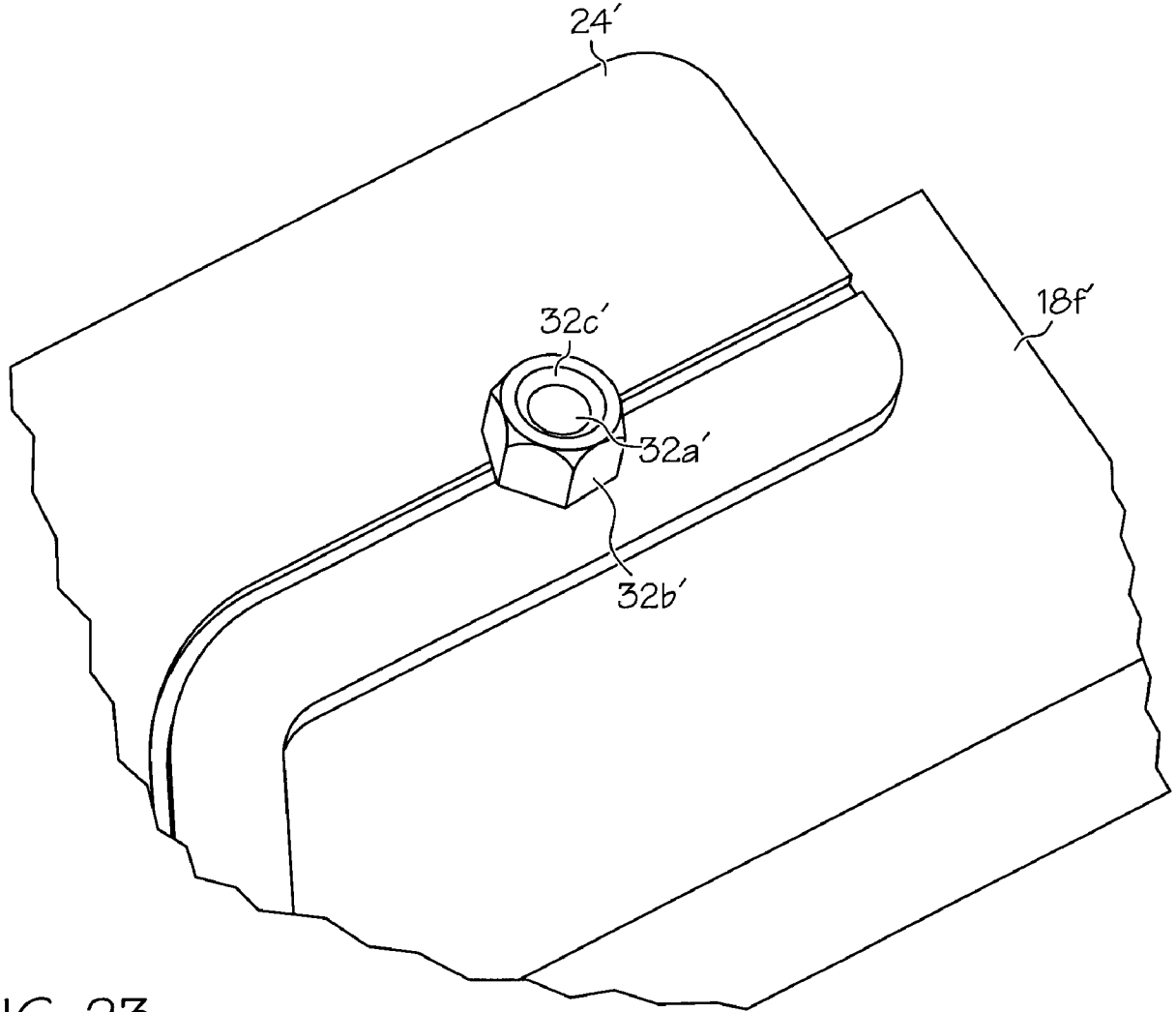
FIG. 23 illustrates a cross-sectional isometric rear view of the modified blade holder assembly with a cross-sectional isometric rear view of the modified blade clamp assembly with a securing screw retention washer or nut thereon according to the second preferred embodiment of the present invention.
Figure 24:
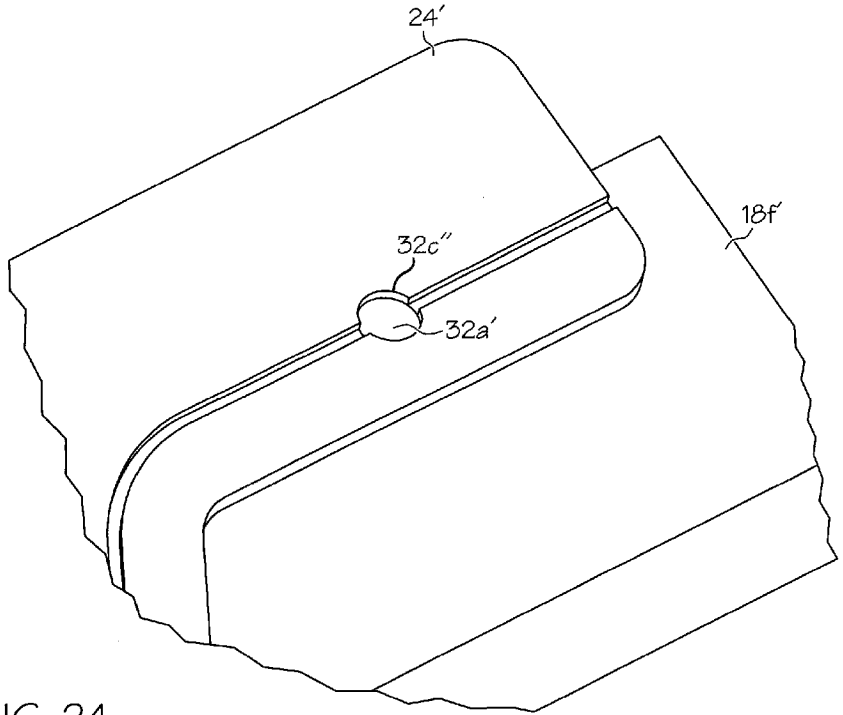
FIG. 24 illustrates a cross-sectional isometric rear view of the modified blade holder assembly with a cross-sectional isometric rear view of the modified blade clamp assembly with a screw counter bore with a securing screw end disposed therein according to the second preferred embodiment of the present invention.

Turning now to FIGS. 23 and 24 which shows isometric cross-sectional views of the rear or back side of the blade holder 24' and the front portion 18*f*' of the second handle portion 18'. FIG. 23 shows a retention washer or nut 32*b*' inserted about the screw end 32*a*' of the screw fastener 32' of the blade clamp member 30'. Element 32*c*' defines a counter bore 32*c*' within the retention washer or nut 32*b*' to allow the screw end 32*a*' to be disposed within the counter bore 32*c*' and eliminating the screw end 32*a*' from extending beyond the counter bore 32*c*' to area outside of the retention washer or nut 32*b*'.

FIG. 24 shows a slight modification from FIG. 23 in that there is no retention nut or washer 32*b*'. Note that counter bore 32*c*" is disposed within the back or rear side of the blade holder 24'. The counter bore 32*c*" shows the screw end 32*a*' being disposed within the counter bore 32*c*" and not extending outside of the counter bore 32*c*".

Details of the operation of this unique multi-function tool will now be described. However, moving from a closed position to a first open position, the spring 37 (not shown in FIGS. 1-24, but is included in the same manner as disclosed for FIGS. 1-9) automatically pivots the complimentary first and second handle portions 13'and 18' to the first open position when the latch member 16' is manually moved by a user along the elongated opening 17' and out of the U-shaped slots 18*c*' for releasably unlatching the complimentary first and second handle portions 13' and 18' This open position allows material or objects to be placed on the cutting surface 23*a*' of the anvil member 23' to be cut.

This movement causes the blade clamp member 30' to be moved or pivoted in an upward position, where the pivot screw fastener 31' is moved to an upper end of the elongated slot 35' of the blade holder 24' causing the rubber gasket or O-ring 34 about the screw fastener 32 to become tightly secured or clamped within the large U-shaped slot to maintain the blade 36' within the angled cut-out receiving cavity or' section 28. The blade 36' has at least a pair of spaced U-shape receiving slots 36*c*' disposed at an upper portion 36*b*'. Also, the lower portion of the blade 36' has a cutting section 36*a*'. The above tight securement is a direct result of one of the adjustment receiving slots 36*c*' receiving the screw fastener 32' therein and being clamped tightly or wedged and guided by the alignment and guide element 30*a*' between the U-shape slot 33' of the blade holder 24' and the rubber gasket or O-ring 34'. The guide element 30*a*' makes sure that the upper portion 36*b*' is always aligned and on the right side of the O-ring 34'.

Note that this clamping position is achieved when a user squeezes the handle portions towards one another so that the blade cutting section 36*a* is forced against the anvil cutting surface 23*a*' so that the blade 36' moves upward with the blade clamp member 30'. Also, the inclined portion 24*b*' will slightly engage the screw fastener 21' in the first open position, and the indented or arcuate portion 24*a*' being positioned to clear the anvil member 23' to mitigate damage to the anvil member 23'.

As a user continues to move the double-sided first handle portion 13' and the double-sided second handle portion 18' further outward from the first open position to the second open blade release position, the spring 37' will move further downward until a click noise is heard or a click feel is felt. Once this click noise is heard or the click feel is felt, the inclined portion 24*b*' will move slightly more in contact with the screw fastener 21' and the arcuate or indented portion 24*a*' still clearing the anvil member 23' to further reduce damage to the anvil member 23'. As the handle portions 13' and 18' are pulled further outward as described above, the blade holder pin 27*a*' will move to an opposite end of the elongated slot 27'. This movement will move the blade holder 24' and the blade clamp member 30' downward. The downward movement allows the pivot screw 31' to move or pivot downward in the elongated slot 35', while simultaneously moving the rubber gasket or O-ring 34' and the screw fastener 32' out of the U-shaped slot 33' to an unclamped position. In this position, the blade 36' is still tightly clamped within one of the receiving slots 36*c*' by preventing the blade from flying out due to clamping action of the rubber gasket or O-ring 34' and the alignment guide 30*a*'. In this position, the user can easily grasped the existing standard blade and pull it out of one of the selected receiving slot 36*c*' and change it with another standard blade with out any tools. Once the new standard blade's receiving slot 36*c*' or 46' receives the screw fastener 32 and aligned on the right side of the rubber gasket or O-ring 34', the user will then pull the handle portions 13' and 18' towards one another against spring 37 so that the blade cutting section 36*a*' is forced against the anvil cutting surface 23*a*' so that the blade 36' moves upward with the blade clamp member 30' and the blade holder 24' to the clamp position as mentioned above.

The advantages of the present invention include without limitation, that the cutting tool or device can be utilized as a utility knife by moving the blade to the other receiving recess so that the blade extend beyond or overhang the anvil by a quarter of an inch (¼"). Another advantage is utilizing standard razor cutting blades with this cutting tool or device, while being able to change the standard razor cutting blades without tools. The flat plastic anvil has the tendency of not dulling the blade. Also, this cutting tool allows for multi-cut capabilities with a mechanical action different from that of scissors. Note that with scissors you are limited to cutting sheets of material, such as paper, fabric and thin plastic. However, this cutting tool has a unique mechanical action of a blade coming down onto a flat anvil member. Further this design combined with a razor sharp blade and an offset pivot point gives you an incredible cutting ability for cutting tough material such as, multiple sheets of paper, rope (nylon), hose, thick leather, thick rubber, rubber molding, copper pipe, copper wiring, plastic, etc.

While the foregoing written description of the invention enables one of ordinary skill in the art to make and use what is considered presently to be the best mode thereof, those of ordinary skill will understand and appreciate the existence of variations, combinations, and equivalents of the specific embodiment, method, and examples herein. The invention should therefore not be limited by the above described embodiment method, and examples, but by all embodiments and methods within the scope and spirit of the invention as claimed.

What is claimed is:

1. A multi-function cutting tool comprising:

a first handle portion having complimentary rear gripping sections, complimentary intermediate securing and pivotal sections and complimentary anvil sections;

a second handle portion having complimentary rear gripping sections, complimentary intermediate securing and pivotal sections and a front section cooperatively associated with a blade holder and blade clamp member, the front section having a U-shaped clamping slot and an elongated clamping slot, each of the intermediate securing and pivotal sections includes a pivotal screw opening and a pin opening;

a pivotal fastening screw element disposed through the complimentary intermediate sections of the first and second handle portions for securing the first and second handle portions together as a single unit;

an anvil member being disposed and secured between the complimentary anvil sections by a plurality of spaced apart screw fastening elements and having an anvil cutting surface;

the blade clamp member is pivotally secured on one side of the front section of the second handle portion by a second plurality of fastening screw elements, one of the second plurality of fastening screw elements being cooperatively associated with the U-shaped clamping slot of the front section, another one of the second plurality of fastening screw elements of the clamp member being movable within the elongated clamping slot of the front section, the blade holder is pivotally secured to the front section of the second handle portion by the second plurality of fastening screw elements of the blade clamp member and another portion of the blade holder being sandwiched between the complimentary intermediate sections of the first and second handle portions and secured thereto by the pivotal fastening screw element that is received within the pivotal screw opening of the front section; a razor blade with at least a pair of selective adjustment slots; The blade holder further includes a razor blade receiving cavity to receive at least an upper portion of the razor blade, a screw fastening opening disposed within the receiving cavity to receive the clamp member screw fastening element that is cooperatively associated with the U-shaped slot and the selective adjustment slots of the razor blade, and an elongated pin opening at a lower end of the blade holder;

an O-ring disposed on the screw fastening element that is cooperatively associated with the U-shaped clamping slot to securely clamp the razor blade within the receiving cavity of the blade holder;

a pin element, the pin element being movably received in the pin openings of the complimentary intermediate securing and pivotal sections of the second handle portion and the elongated pin opening of the blade holder;

a latching elongated slot disposed in the complimentary intermediate sections of the first handle portion, an upstanding fin member defining a U-shaped latching slot that is disposed on the complimentary intermediate sections of the second handle portion and being in alignment and cooperation with the elongated latching slots of the complimentary intermediate sections of the first handle portion; and a pair of latching button members, each of the button members having at least a pair of leg portions on opposite sides thereof and slidably along an outside surface of the complimentary intermediate sections of the first handle portion, each of the button members being inserted into the elongated latching slots from opposite sides of the complimentary intermediate sections of the first handle portion to establish a secure connection so that the button members can move together as a single unit along the elongated latching slots of the complimentary intermediate sections of the first handle portion and selective into and out of the U-shaped latching slot of the second handle portion for enabling the first handle portion and the second handle portion to move between locking and unlocking positions.

2. The multi-function cutting tool according to claim 1, wherein the first and second handle portions being from sheets of stamped metal material, and folded over to form the complimentary first and second handle portions.

3. The multi-function cutting tool according to claim 1, wherein the complimentary anvil sections include a raised reinforcement element disposed thereon to strengthen the anvil sections when material or objects are being cut on the anvil cutting surface.

4. The multi-function cutting tool according to claim 1, wherein the latching button leg portions slide along the outside surface of the complimentary intermediate sections of the first handle portion, along the elongated latching slots of the complimentary intermediate sections of the first handle portion and out of the of the U-shaped latching slot of the second handle portion from the locked position to the unlocked position so that the first handle portion and the double-sided second handle portion can now be moved from a closed position to first and second open positions.

5. The multi-function cutting tool according to claim 1, wherein the leg portions can be utilized as finger grips for a user to easily grasp and move the button members from either side of the complimentary intermediate sections of the first handle portion.

6. The multi-function cutting tool according to claim 1, wherein a flat spring member having one end in constant contact with an upstanding fin member of the second handle portion, another end of the spring being secured at a location on the first handle portion by a screw element, wherein the spring automatically pivots the first and second handle portions to a first open position when a latch button member is manually moved by a user along a latching elongated slot within a portion of the first handle portion and out of at least a U-shaped slot of the upstanding fin member for releasably unlatching the first and second handle portions to allow objects to be placed on the anvil section to be cut.

7. The multi-function cutting tool according to claim 1, wherein the anvil sections including an anvil member having a screw opening at a selected location along a side surface thereof to receive one of the plurality of screw fastening elements, and a U-shaped slot disposed at a rear end surface thereof to receive another one of the plurality of screw fastening elements to allow the anvil member to be adjusted during movement of the another of the plurality of screw fastening elements for proper alignment within the anvil section.

8. The multi-function cutting tool according to claim 1, wherein the anvil sections including an anvil member having a screw opening at a selected location along a side surface thereof to receive one of the plurality of screw fastening elements, a U-shaped slot disposed at a rear end surface thereof to receive another one of the plurality of screw fastening elements to allow the anvil member to slightly pivot while adjusting the another of the plurality of screw fastening elements to properly align the anvil member.

9. The multi-function cutting tool according to claim 8, wherein the blade holder has an indented or arcuate portion on a rear surface for the purpose of clearing the latching button members in all positions of the first and second handle portions, a lower end of the blade holder having an inclined portion and an arcuate portion on a front surface with one end being joined to the inclined portion and another end of the arcuate portion and being joined to the razor blade receiving cavity, wherein the arcuate portion clears the anvil member in all positions of the first and second handle portions and the inclined portion engages the screw fastening element disposed in the U-shaped slot of the anvil member in all open positions of the first and second handle portions so that damage to the anvil member is mitigated.

10. The multi-function cutting tool according to claim 9, wherein the second handle portion has a lower angled surface on a front side having one end connected to one end of the U-shaped clamp slot with another end of the angled surface being connected to one end of an inclined portion, another end of the inclined portion being connected to a bottom surface of the second handle portion adjacent the complimentary intermediate sections, the inclined portion of the second handle portion and the inclined portion of the blade holder never engage the screw fastening element disposed in the U-shaped slot of the anvil member in all open positions of the first and second handle portions, an arcuate portion of the second handle portion is substantially in alignment with the arcuate portion of the blade holder and clears the anvil member in all positions of the first and second handle portions so that damage to the anvil member is always mitigated.

11. The multi-function cutting tool according to claim 1, wherein the pin element moves from one end of the elongated pin opening to another end to permit the blade holder to move together with the second handle portions in all open and closed positions, while at a same time limiting an amount of travel of the blade holder towards the anvil member to mitigate damage thereto.

12. The multi-function cutting tool according to claim 1, wherein at least a portion of the complimentary rear gripping sections of the first and second handle portions has a spacer element secured there between by a plurality of fastening elements to reinforce and maintain the first and second handle portions together as a unit.

13. The multi-function cutting tool according to claim 1, wherein each of the rear gripping sections of the first and second handle portions has a hand gripping cover received thereon, each of the gripping covers has a forward abutment member that limits forward hand movement during gripping actuation of the first and second handle portions, the rear gripping portion of the first handle portions having a sliding razor blade storage tray disposed therein, the first handle portion having a downward and slanted stop member on an undersurface thereof that limits forward movement of the sliding razor blade storage tray and provides a clearance between the undersurface of the first handle portion and the sliding razor blade storage tray, the sliding tray has a forward end that engages the downward and slanted stop member, and a pair of sides having a latching detent element for latching engagement with a detent surface on the interior surface of the gripping cover of the first handle portions and a front gripping portion that allows a user to easily grip and move the sliding storage tray.

14. The multi-function cutting tool according to claim 1, wherein the second handle portion include a first handle section and a second handle section, the second handle section is shorter in length than the first handle section, the shorter length second handle section extends from the rear gripping end to the intermediate securing sections, the first handle section extends from the rear gripping end thereof to a front section thereof that removably attaches the blade holder and blade clamp assembly thereto, thereby allowing the blade holder and the blade clamp member to be exposed externally of the first and second handle portions so that the razor blade can be exposed and easily removed and replaced.

15. The multi-function cutting tool according to claim 1, wherein the pair of selective adjustments slots can be selectively positioned into cooperative engagement with the screw fastening element that is cooperatively associated with the U-shaped clamping slot and the O-ring disposed thereon to easily convert the multi-function tool to a utility knife device.

* * * * *